US008272732B2

(12) United States Patent
Yanagi et al.

(10) Patent No.: US 8,272,732 B2
(45) Date of Patent: Sep. 25, 2012

(54) IMAGE FORMING METHOD

(75) Inventors: Terukazu Yanagi, Kanagawa (JP); Kaoru Tojo, Kanagawa (JP); Yuhei Chiwata, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 107 days.

(21) Appl. No.: 12/903,206

(22) Filed: Oct. 13, 2010

(65) Prior Publication Data

US 2011/0090279 A1 Apr. 21, 2011

(30) Foreign Application Priority Data

Oct. 15, 2009 (JP) ..... 2009-238572

(51) Int. Cl.
*B41J 2/01* (2006.01)

(52) U.S. Cl. ..... 347/104; 347/101

(58) Field of Classification Search ..... 347/95–102, 347/104, 105; 271/5
See application file for complete search history.

(56) References Cited

U.S. PATENT DOCUMENTS

| | | | | |
|---|---|---|---|---|
| 6,832,831 | B2 * | 12/2004 | Shima et al. | 347/102 |
| 2002/0033573 | A1 * | 3/2002 | Kinjyo et al. | 271/194 |
| 2007/0106962 | A1 * | 5/2007 | Sakakibara et al. | 716/1 |
| 2009/0079784 | A1 * | 3/2009 | Chiwata et al. | 347/21 |
| 2009/0163646 | A1 * | 6/2009 | Kato et al. | 524/560 |

FOREIGN PATENT DOCUMENTS

| | | | |
|---|---|---|---|
| JP | 08-283636 | A | 10/1996 |
| JP | 2002-235023 | A | 8/2002 |

* cited by examiner

*Primary Examiner* — Matthew Luu
*Assistant Examiner* — Rut Patel
(74) *Attorney, Agent, or Firm* — SOLARIS Intellectual Property Group, PLLC

(57) ABSTRACT

An image forming method is disclosed, which includes applying a treatment liquid onto a recording medium that has a coated layer and has an area of 1,250 $cm^2$ or more, applying an ink composition including a pigment and resin particles having a glass transition temperature (Tg) of 100° C. or higher onto the recording medium onto which the treatment liquid has been applied and which is conveyed at a conveyance speed of 200 mm/s or higher, heating and drying the applied treatment liquid and ink composition, cooling the recording medium that has been subjected to the heating and drying, to a temperature of 35° C. or lower, and accumulating the recording medium that has been subjected to the cooling, into an accumulation unit.

9 Claims, 5 Drawing Sheets

IMAGE FORMING METHOD

CROSS-REFERENCE TO RELATED APPLICATION

This application is based on and claims priority under 35 USC 119 from Japanese Patent Application No. 2009-238572 filed on Oct. 15, 2009, the disclosure of which is incorporated herein by reference.

BACKGROUND OF THE INVENTION

1. Field of the Invention

The present invention relates to an image forming method in which an ink is ejected by an inkjet method to form an image.

2. Description of the Related Art

As an image recording method for recording color images, various methods have been proposed in recent years. In all of the methods, qualities and grades of images or recorded matters are highly required.

Recently, in the case of carrying out inkjet recording, improvement in recording suitability in order to record at a high speed in accordance with a single pass system, which enables recording with a single operation of the head, instead of a shuttle scanning system which has been generally used hitherto, or in order to form images on both sides of a recording medium is expected.

In conventional inkjet methods, since the printing speed is slow, solvents in the ink are dried or penetrate into the recording medium during printing. Therefore, strength of the spotted ink dots has been ensured. Further, since the ink speed is slow in the conventional methods, the conventional inkjet methods have not been used for printing of a large number of sheets of a recording medium, as well as the obtained recording media have never been stacked in a short time.

However, it has been found that, since in the case of forming an image at a high speed utilizing an inkjet method, the time required for drying is short and recording media are successively stacked, solvents in the stacked recording media can hardly vaporize, and as a result, the recording media are to be stacked with the image units being soft and with the strength of the image units being not ensured, which may cause a phenomenon (which is called stacker blocking) in which images transfer to the backside of the recording media printed successively or the recording media cause sticking to each other to destruct images. This phenomenon appears more remarkable as the number of stacked sheets of a recording medium gets greater and as the area of the recording medium gets bigger, and further, the phenomenon appears more remarkable when a recording medium exhibiting a lower penetration speed is used. For example, stacker blocking does not occur in the case of printing at a low speed onto a recording medium into which ink solvents penetrate quickly, as described in Japanese Patent Application Laid-Open (JP-A) No. 2000-235023.

Further, in offset printing, solid particles are generally sprayed immediately after printing, and therefore, stacker blocking hardly occurs.

In connection to the above, in an inkjet printer in which a double-sided printing mechanism is provided and printing is carried out on a prescribed plain paper at a recording speed of 10 inch/s or higher in order to carry out high-speed recording onto plain paper, a method in which an ink composition containing water, a pigment, and a urethane resin emulsion is used is disclosed (see, for example, JP-A No. 2002-235023).

Moreover, as an inkjet recording ink which is employed in an inkjet recording method in which heat is applied to an ink, that is ejected from an ink discharge head, at the moment the ink reaches a recording medium, an ink containing a pigment, a low MFT (minimum film-forming temperature) resin emulsion having MFT of from 60° C. to 100° C., and a high TG (glass transition temperature) resin emulsion having TG of from 140° C. to 200° C. is disclosed (see, for example, JP-A No. 8-283636). It is described that, according to this technology, drying proceeds faster (see, for example, JP-A No. 8-283636).

SUMMARY OF THE INVENTION

In a method in which solid particles are sprayed immediately after printing as in the conventional technology described above, the sprayed solid particles whirl in the air, or the solid particles, which have been adhered to paper, whirl at the time of double-sided printing, whereby the solid particles adhere to the inkjet head, resulting in causing ill effects such as ejection failure. Therefore, spraying of solid particles cannot be applied to printing by an inkjet system.

Further, in all of the above JP-A Nos. 2002-235023 and 8-283636, it is difficult to prevent stacker blocking which easily occurs when images are formed at a high speed or on both sides of a recording medium.

The stacker blocking is a peculiar problem which may occur when a large number of images are formed or images are formed on both sides of a recording medium by an inkjet system using a coated paper for printing such as a coat paper or an art paper.

The present invention has been made in view of the above circumstances and provides an image forming method.

An aspect of the present invention provides an image forming method, which includes applying a treatment liquid onto a recording medium that has a coated layer and has an area of 1,250 $cm^2$ or more, applying an ink composition including a pigment and resin particles having a glass transition temperature (Tg) of 100° C. or higher onto the recording medium onto which the treatment liquid has been applied and which is conveyed at a conveyance speed of 200 mm/s or higher, heating and drying the applied treatment liquid and ink composition, cooling the recording medium that has been subjected to the heating and drying, to a temperature of 35° C. or lower, and accumulating the recording medium that has been subjected to the cooling, into an accumulation unit.

DETAILED DESCRIPTION OF THE INVENTION

Figure 1:
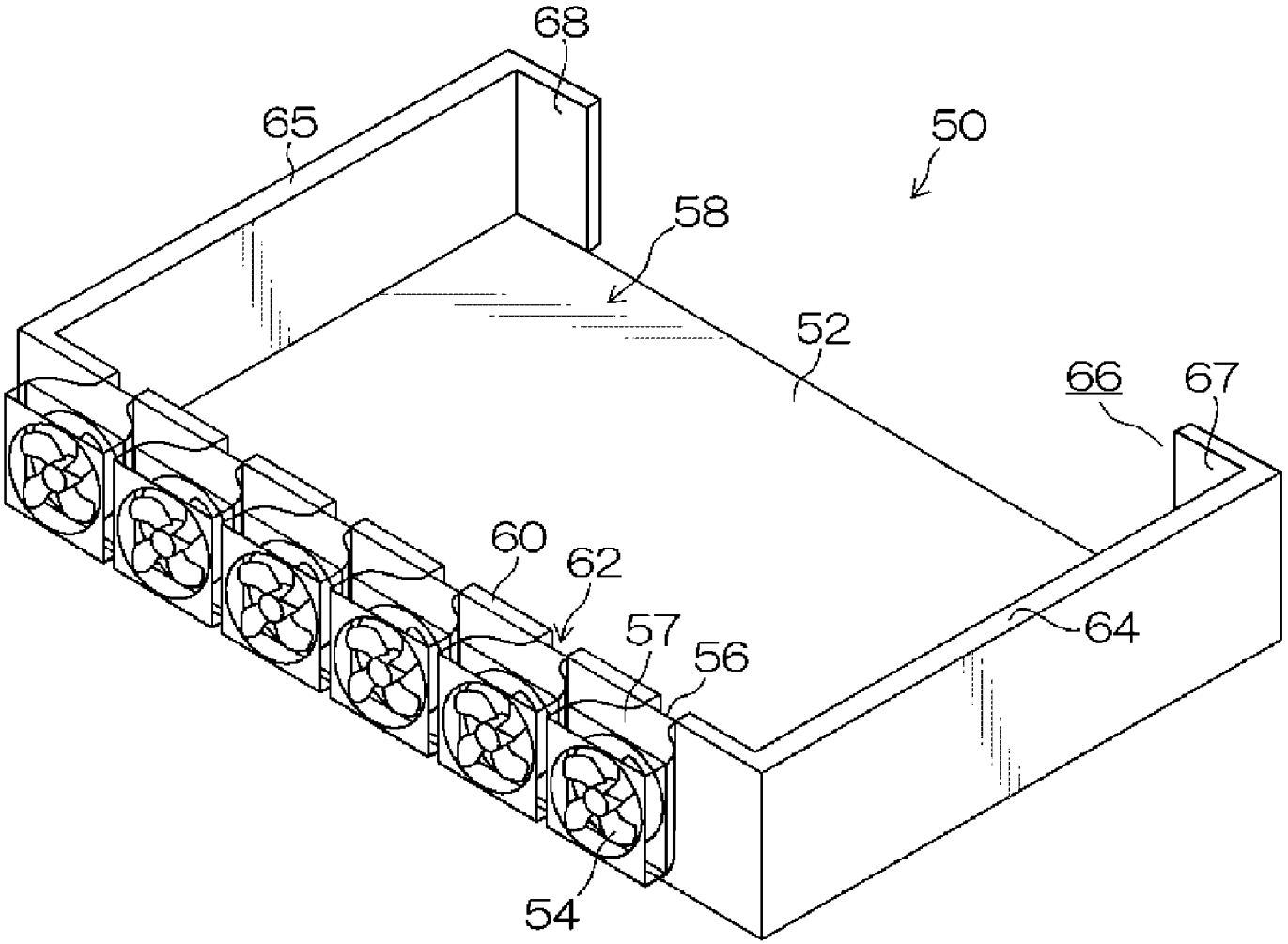
FIG. 1 is a perspective view showing an example of the configuration of a seasoning device.

Hereinafter, the image forming method of the present invention is explained in detail.

The image forming method of the present invention includes applying a treatment liquid onto a recording medium which has a coated layer and has an area of 1,250 $cm^2$ or more (a treatment liquid applying process), applying an ink composition including a pigment and resin particles having a glass transition temperature (Tg) of 100° C. or higher onto the recording medium onto which the treatment liquid has been applied and which is conveyed at a conveyance speed of 200 mm/s or higher (an ink applying process), heating and drying the applied treatment liquid and ink composition (a drying process), cooling the recording medium that has been subjected to the heating and drying, to a temperature of 35° C. or lower (a cooling process), and accumulating the recording medium that has been subjected to the cooling into an accumulation unit (an accumulation process). The image forming method of the present invention may further include other configuration, if necessary.

In the present invention, in the case of forming an image while conveying a recording medium at a conveyance speed of 200 mm/s or higher, an ink composition containing resin particles having Tg of 100° C. or higher is ejected onto the recording medium to which a treatment liquid has been applied in advance, and, after the heating and drying, the recording medium is cooled to a temperature region of 35° C. or lower and then accumulated. Accordingly, the strength of the image units can be maintained even though image formation is carried out in a relatively high speed or on both sides of a recording medium, and thus, stacking with the recording medium being soft is avoided. Thereby, the occurrence of stacker blocking between plural sheets of a recording medium which are stacked is prevented, and it becomes possible to provide printed matters having high image quality and excellent grade.

—Treatment Liquid Applying Process—

In the treatment liquid applying process, a treatment liquid is applied onto a recording medium which has a coated layer and has an area of 1,250 $cm^2$ or more. The treatment liquid is capable of causing an aggregate by aggregating components in the ink composition when contacting with the ink composition. In the present invention, the ink composition is ejected onto the recording medium to which the treatment liquid has been applied in advance, whereby an image is formed. In this case, resin particles or dispersed particles such as particles of a pigment and the like contained in the ink composition aggregate, and an image is fixed on the recording medium. Thereby, inkjet recording may be speeded up, and even when high-speed recording is performed, an image having high density, high resolution, and excellent imaging characteristics (for example, reproducibility of fine lines or fine portions) may be obtained.

Supply of the treatment liquid may be performed by applying a known method such as a coating method, an inkjet method, or an immersion method. Examples of the coating method include known coating methods using a bar coater, an extrusion die coater, an air doctor coater, a blade coater, a rod coater, a knife coater, a squeeze coater, a reverse roll coater, a bar coater, or the like. Details on the inkjet method are described below.

In the present invention, ejection by an inkjet method is preferable from the viewpoint of suppressing increase in the application amount of the treatment liquid.

The treatment liquid may include at least one aggregating component capable of causing an aggregate by aggregating components in the ink composition when contacting with the ink composition. As a result of the treatment liquid mixing into the ink composition ejected by an inkjet method, aggregation of pigment and the like that have been stably dispersed in the ink composition may be promoted.

The treatment liquid is, for example, a liquid that is capable of causing formation of an aggregate by changing the pH of the ink composition. In this case, the pH (at 25° C.±1° C.) of the treatment liquid is preferably 6 or lower, more preferably from 1 to 6, still more preferably from 1.2 to 5, and even more preferably from 1.5 to 4, from the viewpoint of the coagulation speed of the ink composition. In this case, the pH (at 25° C.±1° C.) of the ink composition to be ejected is preferably from 7.5 to 9.5, and more preferably from 8.0 to 9.0.

In the invention, it is preferable that the pH (at 25° C.±1° C.) of the ink composition is 7.5 or higher and that the pH of the treatment liquid (at 25° C.±1° C.) is from 1.5 to 3, from the viewpoints of image density, resolution, and inkjet recording at higher speeds.

The aggregating component may be used singly, or two or more thereof may be used in mixture.

The treatment liquid may include at least one acidic compound as an aggregating component. Examples of acidic compounds that can be used include compounds having a phosphoric acid group, a phosphonic acid group, a phosphinic acid group, a sulfuric acid group, a sulfonic acid group, a sulfinic acid group, or a carboxyl group, and salts thereof (such as polyvalent metal salts thereof). From the viewpoint of coagulation speed of the ink composition, compounds having a phosphoric acid group or a carboxyl group are preferable, and compounds having a carboxyl group are more preferable.

The compounds having a carboxyl group are preferably selected from polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyronecarboxylic acid, pyrrolecarboxylic acid, furancarboxylic acid, pyridinecarboxylic acid, coumalic acid, thiophenecarboxylic acid, and nicotinic acid, derivatives of these compounds, and salts thereof (such as polyvalent metal salts thereof).

The treatment liquid may include, as an aggregating component, at least one selected from a group consisting of polyvalent metal salts, polyallylamines, and polyallylamine derivatives. Use of this treatment liquid may improve high-speed aggregation properties. Examples of the polyvalent metal salt include: a salt of an alkaline earth metal, which belongs to Group 2 of the Periodic Table, such as magnesium or calcium; a salt of a transition metal belonging to Group 3 of the Periodic Table, such as lanthanum; a salt of a cation of an element belonging to Group 13 of the Periodic Table, such as aluminum; and a salt of a lanthanide, such as neodymium. The salt of such a metal is preferably a carboxylic acid salt (such as a formate, acetate, or benzoate), a nitrate, a chloride, or a thiocyanate. In particular, the following salts are preferable: a calcium or magnesium salt of a carboxylic acid (such as formic acid, acetic acid, or benzoic acid); a calcium or magnesium salt of nitric acid; calcium chloride; magnesium chloride; and a calcium or magnesium salt of thiocyanic acid.

The content of polyvalent metal salt in the treatment liquid is preferably from 1% by mass to 10% by mass, more preferably from 1.5% by mass to 7% by mass, and still more preferably from 2% by mass to 6% by mass, form the viewpoint of aggregation effects.

The treatment liquid may include at least one cationic organic compound as an aggregating agent. Examples of the cationic organic compound include cationic polymers such as a poly(vinylpyridine) salt, poly(alkylaminoethyl acrylate), poly(alkylaminoethyl methacrylate), poly(vinylimidazole), polyethyleneimine, polybiguanide, polyguanide, and polyallylamine, and derivatives thereof.

The weight average molecular weight of the cationic polymer is preferably smaller from the viewpoint of the viscosity of the treatment liquid. When the treatment is applied to a recording medium by an inkjet method, the weight average molecular weight of the cationic polymer is preferably in the range of from 1,000 to 500,000, more preferably from 1,500 to 200,000, and still more preferably from 2,000 to 100,000. A weight average molecular weight of 1000 or more is preferable in terms of aggregation speed, and a weight average molecular weight of 500,000 or less is preferable in terms of ejection reliability. The above preferable ranges do not necessarily apply when the treatment liquid is applied to a recording medium by methods other than inkjet.

The cationic organic compound is preferably, for example, a primary, secondary, or tertiary amine salt-type compound. Examples of the amine salt-type compound include a cationic amine salt-type compound and an amphoteric surfactant that exhibits cationic properties at a desired pH range. Examples of the cationic amine salt-type compound include: hydrochloride or acetate of an amine, such as hydrochloride or acetate of laurylamine, cocoamine, stearylamine, rosin amine, or the like; a quaternary ammonium salt compound such as lauryl trimethyl ammonium chloride, cetyl trimethyl ammonium chloride, lauryl dimethyl benzyl ammonium chloride, benzyl tributyl ammonium chloride, or benzalkonium chloride; a pyridinium salt compound such as cetylpyridinium chloride or cetylpyridinium bromide; an imidazoline-based cationic compound such as 2-heptadecenyl-hydroxyethyl imidazoline; and an ethyleneoxide adduct of a higher alkylamine such as dihydroxyethyl stearylamine. Examples of the amphoteric surfactant that exhibits cationic properties at a desired pH range include: amino acid-type amphoteric surfactant, a compound having a structure represented by R—NH—$CH_2CH_2$—COOH(R representing an alkyl group or the like), a carboxylate-type amphoteric surfactant such as stearyl dimethyl betaine or lauryl dihydroxyethyl betaine, a sulfuric ester-type amphoteric surfactant, a sulfonic acid-type amphoteric surfactant, and a phosphoric ester-type amphoteric surfactant.

Among them, the cationic organic compound preferably has di- or higher-valency.

The content of cationic organic compound in the treatment liquid is preferably from 1% by mass to 50% by mass, and more preferably from 2% by mass to 30% by mass, from the viewpoint of aggregation effects.

Among them, a di- or higher-valent carboxylic acid or a di- or higher-valent cationic organic compound is preferable as an aggregating component, from the viewpoints of aggregation properties and abrasion resistance of an image.

The viscosity of the treatment liquid is preferably in the range of from 1 mPa·s to 30 mPa·s, more preferably from 1 mPa·s to 20 mPa·s, and still more preferably from 2 mPa·s to 15 mPa·s, and particularly preferably from 2 mPa·s to 10 mPa·s, from the viewpoint of the coagulation speed of the ink composition. Here, the viscosity is measured using a VISCOMETER TV-22 (tradename, manufactured by TOKI SANGYO CO. LTD) at 20° C.

The surface tension of the treatment liquid is preferably from 20 mN/m to 60 mN/m, more preferably from 20 mN/m to 45 mN/m, and still more preferably from 25 mN/m to 40 mN/m, from the viewpoint of the coagulation speed of the ink composition. Here, the surface tension is measured using an automatic surface tensiometer CBVP-Z (tradename, manufactured by Kyowa Interface Science Co., Ltd.) at 25° C.

The amount of the treatment liquid to be applied is not particularly limited as long as the treatment liquid is capable of coagulating the ink composition. The amount of the treatment liquid to be applied is preferably such an amount as to adjust the amount of aggregating component (such as a compound having a carboxyl group or a cationic organic compound) applied to 0.1 g/$m^2$ or higher. The amount of the treatment liquid is more preferably such that the amount of the aggregating component applied is adjusted to be from 0.1 to 1.0 g/$m^2$, still more preferably such that the amount of the aggregating component applied is adjusted to be from 0.2 to 0.8 g/$m^2$. When the amount of the aggregating component applied is 0.1 g/$m^2$ or more, the aggregation reaction proceeds favorably. When the amount of the aggregating component applied is 1.0 g/$m^2$ or less, gloss is not excessively high.

In the invention, it is preferable that a heating and drying process of heating and drying the treatment liquid on the recording medium is further conducted during a period from after the application of the treatment liquid onto the recording medium to the application of the ink composition. Heating and drying of the treatment liquid performed in advance of the ink application process may realize favorable ink coloring properties such as bleed prevention, and may realize recording of a visible image having excellent color density and excellent hue.

The heating and drying can be carried out by a conventional heating means such as a heater, a blow means utilizing blown from a dryer or the like, or a means combining these. Examples of heating methods include a method of applying heat by a heater or the like from the surface of the recording medium opposite from the surface applied with the treatment liquid, a method of blowing a warm air or hot air to the surface of the recording medium applied with the treatment liquid, and a method of heating using an infrared heater. Heating can also be performed by using two or more of these methods in combination.

In the present invention, the treatment liquid is applied onto a recording medium which has a coated layer and has an area of 1,250 $cm^2$ or more. The recording medium having a coated layer means a coated paper which is used in general offset printing and the like. Coated papers are prepared by providing coat layers through coating coat materials on surfaces of wood free papers, acid-free papers, or the like.

The area of 1,250 $cm^2$ or more indicates that the application amount of the ink applied at the time of image formation is relatively large, and in a case in which the area is 1,250 $cm^2$ or more, stacker blocking easily occurs.

In the recording medium according to the present invention, the coated layers are preferably in an amount of 12 g/$m^2$ or more in total of both sides, and more preferably 18 g/$m^2$ or more. Papers having coated layers in an amount of 12 g/$m^2$ or more in total of both sides are coated papers used for general offset printing and the like. When the amount of the coated layers is within the above range, a large amount of ink may be absorbed, and a large effect may be produced in the present invention.

Further, the basis weight of the recording medium is preferably from 70 g/$m^2$ to 350 g/$m^2$, and more preferably from 70 g/$m^2$ to 200 g/$m^2$. Papers used for general offset printing and the like have a basis weight within this range. In the case where the basis weight is within the above range, a large amount of ink may be absorbed, and a large effect may be produced in the present invention.

With regard to coated papers, ink absorption slowly proceeds in conventional image formation by general aqueous ink jetting. Particularly, in the case of forming an image at a high speed or on both sides of a recording medium, absorption and drying of ink proceed too slowly, and when plural sheets are stacked and accumulated, stacker blocking by which image transfers between the recording media may easily occur. However, in the image forming method of the present invention, the occurrence of stacker blocking may be prevented, and high-grade images with fine lines and fine image units being definite and uniform may be formed.

In the present invention, particularly, it is preferable to use a coated paper having a base paper and a coat layer including kaolin and/or potassium bicarbonate. More specifically, an art paper, a coat paper, a lightweight coat paper, or a very lightweight coated paper is more preferable.

The recording medium may be a commercially-available product, and examples thereof include general coated papers for printing. Specific example include very light-weight coated papers such as OK EVER LIGHT COATED (trade name) manufactured by Oji Paper Co., Ltd. and AURORA S (trade name) manufactured by Nippon Paper Industries Co., Ltd.; lightweight coat papers (A3) such as OK KOTE (L) (trade name) manufactured by Oji Paper Co., Ltd. and AURORA L (trade name) manufactured by Nippon Paper Industries Co., Ltd.; coat papers (A2, B2) such as TOPKOTE PLUS (tradename) manufactured by Oji Paper Co., Ltd. and AURORA COAT (trade name) and U-LITE (trade name) manufactured by Nippon Paper Industries Co., Ltd.; and art papers (A1) such as 2/SIDE GOLDEN CASK GLOSS (trade name) manufactured by Oji Paper Co., Ltd. and TOKUBISHI ART (trade name) manufactured by Mitsubishi Paper Mills Ltd.

Among them, a recording medium having a water absorption coefficient Ka of from 0.05 $mL/m^2 \cdot ms^{1/2}$ to 0.5 $mL/m^2 \cdot ms^{1/2}$ is preferable, a recording medium having a water absorption coefficient Ka of from 0.1 $mL/m^2 \cdot ms^{1/2}$ to 0.4 $mL/m^2 \cdot ms^{1/2}$ is more preferable, and a recording medium having a water absorption coefficient Ka of from 0.2 $mL/m^2 \cdot ms^{1/2}$ to 0.3 $mL/m^2 \cdot ms^{1/2}$ is still more preferable, from the viewpoints of obtaining large effects in suppression of colorant migration and obtaining a high-quality image having more favorable color density and hue than before.

The water absorption coefficient Ka has the same definition as that described in JAPAN TAPPPI Pulp and Paper Testing Method No. 51: 2000 (published by JAPAN TAPPI), the disclosure of which is incorporated by reference herein. Specifically, the water absorption coefficient Ka is calculated from a difference in water transfer amount between a contact time of 100 ms and a contact time of 900 ms that are measured using an automatic scanning liquid absorptometer KM500win (manufactured by KUMAGAI RIKI KOGYO CO., LTD.).

—Ink Applying Process—

In the ink applying process, an ink composition which includes a pigment and a resin particle having a glass transition temperature (Tg) of 100° C. or higher is applied onto the recording medium onto which the treatment liquid has been applied and which is conveyed at a conveyance speed of 200 mm/s or higher. The ink applying process in the present invention is a process of forming an image on a recording medium which is conveyed at a relatively high conveyance speed of 200 mm/s or higher. Even in the case of forming an image at such a high speed, occurrence of stacker blocking between the recording media can effectively be suppressed. It should be noted that, in the image forming system in which the conveyance speed is lower than 200 mm/s, frequency of occurrence of stacker blocking is low.

It is preferable that the conveyance speed is higher, from the viewpoint of attaining high-speed image formation. Specifically, the case in which the conveyance speed is 400 mm/s or higher is more preferable.

Specifically, image formation employing an inkjet method may be performed by ejecting the treatment liquid onto a desired recording medium by application of energy. Examples of an image forming method that is preferred in the invention include the method described in paragraphs [0093] to [0105] of JP-A No. 2003-306623. The inkjet method is not particularly limited, and may be any known method such as a charge-control method in which ink is ejected by electrostatic attraction force; a drop-on-demand method (pressure-pulse method) in which a pressure of oscillation of a piezo element is utilized; an acoustic inkjet method in which ink is ejected by radiation pressure generated by irradiation of ink with acoustic beams that have been converted from electric signals; and a thermal inkjet method in which ink is ejected by a pressure generated by formation of bubbles caused by heating of ink (BUBBLEJET, registered trademark).

The inkjet head used in an inkjet method may be either an on-demand type head or a continuous type head. Examples of ejection systems include electromechanical transduction systems (such as a single-cavity system, a double-cavity system, a vendor system, a piston system, a share-mode system and a shared-wall system), electrothermal transduction systems (such as a thermal inkjet system and a BUBBLE-JET (registered trademark) system), electrostatic suction systems (such as an electric-field-control system and a slit-jet system), and discharge systems (such as a spark jet system), and any of these ejection systems is applicable. The ink nozzles and the like used for the inkjet recording are not particularly limited, and may be selected as appropriate according to applications.

Regarding the inkjet head, there are (i) a shuttle system in which recording is performed while a short serial head having a small length is moved in the width direction of a recording medium in a scanning manner, and (ii) a line system in which a line head having recording devices that are aligned to correspond to the entire length of one side of a recording medium is used. In the line system, image recording can be performed over the whole of one surface of a recording medium by moving the recording medium in a direction orthogonal to the direction along which the recording devices are aligned, and a conveyance system, such as carriage, which moves the short head in a scanning manner is unnecessary. Since a complicated scan-movement control of the movement of the carriage and the recording medium is unnecessary, the recording speed can be increased.

The ejected ink amount per droplet is preferably from 0.5 pl to 6 pl, more preferably from 1 pl to 5 pl, and still more preferably from 2 pl to 4 pl, from the viewpoint of obtaining a high resolution image.

The ink composition that is applied in the ink applying process includes a pigment and resin particles having a glass transition temperature (Tg) of 100° C. or higher, and preferably further includes a water-soluble organic solvent, water, and a surfactant. Other components may be used, as necessary, to form the ink composition.

Pigment

The ink composition according to the present invention includes at least one pigment. The pigment can be suitably selected depending on the purposes, and either of an organic pigment or an inorganic pigment may be used.

Examples of the organic pigment include an azo pigment, a polycyclic pigment, a dye chelate, a nitro pigment, a nitroso pigment, and aniline black. Among them, an azo pigment and a polycyclic pigment are preferable. Examples of the azo pigment include azo lake, an insoluble azo pigment, a condensed azo pigment, and a chelate azo pigment. Examples of the polycyclic pigment include a phthalocyanine pigment, a perylene pigment, a perynone pigment, an anthraquinone pigment, a quinacridone pigment, a dioxazine pigment, an indigo pigment, a thioindigo pigment, an isoindolinone pigment, and a quinophthalone pigment. Examples of the dye chelate include a basic dye chelate and an acid dye chelate. Further, examples of the inorganic pigment include titanium oxide, iron oxide, calcium carbonate, barium sulfate, aluminum hydroxide, barium yellow, cadmium red, chrome yellow, and carbon black. Among them, carbon black is particularly preferable. Note that, examples of the carbon black include those manufactured by a known method such as a contact method, a furnace method, or a thermal method. Among these pigments, water-dispersible pigments are preferable.

Specific examples of the water-dispersible pigment include the following pigments (1) to (4).

(1) Encapsulated pigment: that is, a polymer dispersion formed by incorporating a pigment in polymer particles. More specifically, the encapsulated pigment is formed by coating a pigment with a hydrophilic water-insoluble resin to hydrophilize the pigment by the resin layer on the pigment surface so that the coated pigment is dispersible in water.

(2) Self-dispersible pigment: that is, a pigment that has at least one kind of hydrophilic group on the surface and exhibits at least either of water dispersibility or water solubility in the absence of a dispersant. More specifically, the self-dispersible pigment is formed by subjecting a pigment, for example, mainly carbon black or the like, to a surface oxidation treatment to hydrophilize, thereby making the pigment dispersible in water as a pigment single body.

(3) Resin-dispersed pigment: that is, a pigment dispersed by a water-soluble polymer compound having a weight-average molecular weight of 50,000 or less.

(4) Surfactant-dispersed pigment: that is a pigment dispersed by a surfactant.

Preferable examples as the water-dispersible pigment in the invention include the (1) encapsulated pigment and the (2) self-dispersible pigment. More preferable examples include the (1) encapsulated pigment.

The (1) encapsulated pigment will be described in detail.

A resin for use in the encapsulated pigment is not limited, but it is preferably a polymer compound having a self-dispersion capability or dissolution capability in a mixed solvent of water and a water-soluble organic solvent, and having an anionic group (acidic group). The resin preferably has a number average molecular weight in the range of around 1,000 to 100,000, and more preferably a number average molecular weight in the range of around 3,000 to 50,000. Further, a resin that dissolves in an organic solvent to form a solution is preferable. When the resin has the number average molecular weight in this range, it can sufficiently exert functions as a coating film for pigments, or as a coating film in inks The resin is preferably used in a form of a salt of alkali metal or organic amine.

Specific examples of resins for the encapsulated pigment include materials having an anionic group such as thermoplastic, thermo-curable, or modified acrylic-based, epoxy-based, polyurethane-based, polyether-based, polyamide-based, unsaturated polyester-based, phenol-based, silicone-based or fluorine-containing polymer compounds; polyvinyl-based resins such as vinyl chloride, vinyl acetate, polyvinyl alcohol and polyvinyl butyral; polyester-based resins such as alkyd resin and phthalic acid resin; amino-based materials such as melamine resin, melamine-formaldehyde resin, aminoalkyd co-condensed resin and urea resin; and copolymers and mixtures thereof.

Among these resins, the anionic acrylic-based resin can be obtained, for example, by polymerizing an acrylic monomer having an anionic group (hereinafter, referred to as an anionic group-containing acrylic monomer), and, further, another monomer(s) copolymerizable with the anionic group-containing acrylic monomer, according to need, in a solvent. Examples of anionic group-containing acrylic monomers include acrylic monomers having one or more anionic groups selected from the group consisting of a carboxyl group, a sulfonic acid group and a phosphonic group. Among these, acrylic monomers having a carboxyl group are more preferable. Specific examples of acrylic monomers having a carboxyl group include acrylic acid, methacrylic acid, crotonic acid, ethacrylic acid, propylacrylic acid, isopropylacrylic acid, itaconic acid, fumaric acid and the like. Among these, acrylic acid and methacrylic acid are preferable.

The encapsulated pigment can be manufactured by a conventional physical method or a chemical method with the use of the aforementioned components. In the invention, the encapsulated pigment is preferably manufactured by any of the methods disclosed in JP-A Nos. 9-151342, 10-140065, 11-209672, 11-172180, 10-25440 or 11-43636. Specifically, the encapsulated pigment may be manufactured by, for example, a phase conversion emulsification method or an acid precipitation method disclosed in JP-A No. 9-151342 or 10-140065. From the viewpoint of dispersion stability, a phase inversion emulsification method is preferable. The phase inversion emulsification method is described below.

The self-dispersible pigment may also be mentioned as a preferable example. The self-dispersible pigment is a pigment formed by bonding many hydrophilic functional groups and/or salts thereof (hereinafter, referred to as a dispersibility-providing group) to the surface of a pigment directly or indirectly via an alkyl group, an alkylether group, aryl group or the like to be made dispersible in an aqueous medium without a dispersant for dispersing a pigment. Here, the phrase "dispersible in an aqueous medium without a dispersant" means that dispersion in an aqueous medium can be achieved even when a dispersant for dispersing a pigment is not used.

In general, an ink that contains the self-dispersible pigment as a colorant is not required to contain a dispersant which is used for dispersing a pigment as described above, and, therefore, it is possible to easily prepare an ink in which foam formation due to the lowering of defoaming property caused by the dispersant scarcely occurs, and which is excellent in ejection stability. Examples of the dispersibility-providing group, which is bonded to the surface of the self-dispersible pigment, include —COOH, —CO, —OH, $—SO_3H$, $—PO_3H_2$ and quaternary ammonium, and salts thereof. The dispersibility-providing groups can be bonded by subjecting a pigment that is a raw material to a physical treatment or a chemical treatment, thereby bonding (grafting) the dispersibility-providing group or an active species having the dispersibility-providing group to the surface of the pigment. Examples of the physical treatment include a vacuum plasma treatment and the like. Examples of the chemical treatment include a wet oxidation method in which the pigment surface is oxidized with an oxidant in water, and a method in which p-aminobenzoic acid is bonded to the surface of a pigment, thereby bonding a carboxyl group via a phenyl group to the pigment.

In the invention, preferable examples of the self-dispersible pigment include self-dispersible pigments that are surface-treated by an oxidation treatment with hypohalous acid and/or a hypohalous acid salt, or an oxidation treatment with ozone. As the self-dispersible pigments, commercially available products may be used. Examples thereof include MICROJET CW-1 (trade name; manufactured by Orient Chemical Industries), and CAB-O-JET200 and CAB-O-JET300 (trade names; manufactured by CABOT Corporation).

The pigment is preferably an encapsulated pigment in which a water-insoluble resin among the pigment dispersants is used and at least a part of the surface of a pigment is coated with the water-insoluble resin, for example, a polymer emulsion in which a pigment is incorporated in a water-insoluble resin particle. More specifically, the pigment is preferably a water-dispersible pigment prepared by coating at least a part of a pigment with a water-insoluble resin to form a resin layer on the surface of the pigment, thereby enabling dispersing in water.

Here, the phase inversion emulsification method is explained.

The phase inversion emulsification method is fundamentally a self dispersion (phase inversion emulsification) method for dispersing, in water, a mixed fused product of a resin having self-dispersibility or solubility and a pigment. The mixed fused product may include a curing agent and/or polymer compound. Here, the mixed fused product means those in a mixed state without being dissolved, a mixed state being dissolved, or the both states. More specific method of the "phase inversion emulsification method" is described in JP-A No. 10-140065.

Further, more specific methods of the above phase inversion emulsification method and acid precipitation method can be referred to JP-A Nos. 9-151342 and 10-140065.

Pigment Dispersant

When a pigment dispersant is used, dispersion of the pigment may be facilitated and more stable dispersion state after dispersing may be attained. Examples of the pigment dispersant include nonionic compounds, anionic compounds, cationic compounds and amphoteric compounds.

For example, copolymers in which a monomer having an α,β-ethylenically unsaturated group is used are mentioned. Examples of a monomer having an α,β-ethylenically unsaturated group include ethylene, propylene, butene, pentene, hexene, vinyl acetate, allyl acetate, acrylic acid, methacrylic acid, crotonic acid, crotonic acid ester, itaconic acid, itaconic acid monoester, maleic acid, maleic acid monoester, maleic acid diester, fumaric acid, fumaric acid monoester, vinylsulfonic acid, styrenesulfonic acid, sulfonated vinylnaphthalene, vinyl alcohol, acrylamide, methacryloxyethyl phosphate, bismethacryloxyethyl phosphate, methacryloxyethylphenyl acid phosphate, ethylene glycol dimethacrylate, diethylene glycol dimethacrylate, styrene, styrene derivatives such as α-methylstyrene and vinyl toluene, vinyl cyclohexane, vinyl naphthalene, vinyl naphthalene derivatives, acrylic acid alkyl ester that may be substituted by an aromatic group, acrylic acid phenyl ester, methacrylic acid alkyl ester that may be substituted by an aromatic group, methacrylic acid phenyl ester, methacrylic acid cycloalkyl ester, crotonic acid alkyl ester, itaconic acid dialkyl ester, maleic acid dialkyl ester, derivatives of aforementioned compounds, and the like.

Homopolymers of the monomer having an α,β-ethylenically unsaturated group or copolymers obtained by copolymerizing plural kinds of monomers having an α,β-ethylenically unsaturated group may be used as a polymer dispersant. Specific examples thereof include acrylic acid alkyl ester-acrylic acid copolymer, methacrylic acid alkyl ester-methacrylic acid copolymer, styrene-acrylic acid alkyl ester-acrylic acid copolymer, styrene-methacrylic acid phenyl ester-methacrylic acid copolymer, styrene-methacrylic acid cyclohexyl ester-methacrylic acid copolymer, styrene-styrene sulfonic acid copolymer, styrene-maleic acid copolymer, styrene-methacrylic acid copolymer, styrene-acrylic acid copolymer, vinylnaphthalene-maleic acid copolymer, vinylnaphthalene-methacrylic acid copolymer, vinylnaphthalene-acrylic acid copolymer, polystyrene, polyester, polyvinyl alcohol and the like.

The pigment dispersant preferably has a weight-average molecular weight of 2,000 to 60,000.

The addition amount of the dispersant relative to the pigment is preferably in the range from 10% to 100% by mass, more preferably from 20% to 70% by mass, furthermore preferably from 40% to 50% by mass.

The pigments may be used in one kind alone, or plural kinds of the pigments may be selected from each of the above groups or among the above groups and used in combination.

The content of the pigment in the ink is preferably from 0.1% by mass to 15% by mass, more preferably from 0.5% by mass to 12% by mass, and particularly preferably from 1% by mass to 10% by mass, with respect to the total mass of the ink, from the viewpoints of color density, granularity, stability of the ink, and ejection reliability.

Resin Particles

The ink composition according to the present invention includes at least one type of resin particles. Using resin particles makes it possible to effectively improve abrasion resistance of the image formed.

Specific examples of the resin particles include particles of a resin having an anionic group, for example, a thermoplastic, thermo-curable, or modified acrylic-based, epoxy-based, polyurethane-based, polyether-based, polyamide-based, unsaturated polyester-based, phenol-based, silicone-containing or fluorine-containing resin; a polyvinyl-based resin such as vinyl chloride, vinyl acetate, polyvinyl alcohol or polyvinyl butyral; a polyester-based resin such as an alkyd resin or a phthalic acid resin; an amino-based material such as a melamine resin, a melamine-formaldehyde resin, an aminoalkyd co-condensed resin or a urea resin; or a copolymer or a mixture thereof. Among the above resins, an anionic acrylic-based resin may be obtained, for example, by polymerizing an acrylic monomer having an anionic group (anionic group-containing acrylic monomer), and, further, other monomer(s) copolymerizable with the anionic group-containing acrylic monomer, as needs arise, in a solvent. Examples of the anionic group-containing acrylic monomer include acrylic monomers having one or more groups selected from the group consisting of a carboxyl group, a sulfonic acid group and a phosphonic acid group. Among them, acrylic monomers having a carboxyl group (for example, acrylic acid, methacrylic acid, crotonic acid, ethacrylic acid, propylacrylic acid, isopropylacrylic acid, itaconic acid, fumaric acid, and the like) are more preferable, and acrylic acid and methacrylic acid are particularly preferable.

The resin particles are preferably particles of a self-dispersing polymer, and more preferably particles of a self-dispersing polymer having a carboxyl group, from the viewpoints of ejection stability and dispersion stability of the pigment. Particles of a self-dispersing polymer means particles of a water-insoluble polymer which can be in a dispersed state in an aqueous medium due to the functional group (particularly, an acid group or a salt thereof) of the polymer itself, in the absence of additional surfactants, wherein the water-insoluble polymer does not contain a free emulsifier.

The scope of the term "dispersed state" used herein includes both an emulsified state (emulsion) in which a water-insoluble polymer in the liquid state is dispersed in an aqueous medium and a dispersed state (suspension) in which a water-insoluble polymer in the solid state is dispersed in an aqueous medium.

The water-insoluble polymer in the invention is preferably a water-insoluble polymer that can get into a dispersed state in which the water-insoluble polymer is dispersed in the solid state, in consideration of aggregation speed and ink fixability when the water-insoluble polymer is contained in a ink composition.

A phase inversion emulsification method may be used as a method of achieving an emulsified state or dispersed state of the self-dispersing polymer (i.e., as a method of preparing an aqueous dispersion of the self-dispersing polymer). The phase inversion emulsification method may be, for example, a method including dissolving or dispersing the self-dispersing polymer in a solvent (for example, a hydrophilic organic solvent), directly adding the obtained liquid into water rather than adding a surfactant, stirring and mixing the resultant liquid in a state in which the salt-forming groups (such as acid groups) of the self-dispersing polymer are neutralized, and removing the solvent so as to obtain an aqueous dispersion that is in an emulsified or dispersed state.

The following procedure can be used to determine whether a water-insoluble polymer is a self-dispersing polymer as defined herein: 30 g of a water-insoluble polymer is dissolved in 70 g of an organic solvent (such as methyl ethyl ketone) to form a solution, the solution is mixed with 200 g of water and a neutralizing agent that can neutralize the salt-forming groups of the water-insoluble polymer to a degree of 100% (sodium hydroxide if the salt-forming groups are anionic, or acetic acid if the salt-forming groups are cationic), the mixture is agitated with an agitator having an agitation blade at a rotation rate of 200 rpm at 25° C. for 30 minutes, and the organic solvent is removed from the mixture liquid. If a stable emulsion or dispersion state of the water-insoluble polymer in the mixture liquid and absence of precipitation are confirmed by visual observation for at least one week at 25° C. after the removal of the organic solvent, the water-insoluble polymer is considered to be a self-dispersing polymer.

The stability of the emulsified or dispersed state of the self-dispersing polymer can be confirmed also by an accelerated sedimentation test involving centrifugal separation. The stability in the accelerated sedimentation test involving centrifugal separation can be evaluated by, for example, adjusting the aqueous dispersion of the polymer particles obtained as described above to have a solids concentration of 25% by mass, centrifuging the resultant aqueous dispersion at 12,000 rpm for one hour, and measuring the solids content of a supernatant after the centrifugal separation.

If the ratio of the solids content after centrifugal separation to the solids content before centrifugal separation is large (a value close to 1), it is indicated that sedimentation of the polymer particles due to centrifugal separation does not occur; in other words, the aqueous dispersion of the polymer particles is more stable. In the invention, the ratio of the solids content after centrifugal separation to the solids content before centrifugal separation is preferably 0.8 or higher, more preferably 0.9 or higher, and particularly preferably 0.95 or higher.

The term "water-insoluble polymer" as used herein refers to a polymer that shows a solubility of 10 g or less when the polymer is dried at 105° C. for 2 hours and then dissolved in 100 g of water at 25° C. The solubility is preferably 5 g or less, and more preferably 1 g or less. The solubility described above is a value measured after the polymer is 100% neutralized with sodium hydroxide or acetic acid depending on the type of the salt-forming groups of the water-insoluble polymer.

In the self-dispersing polymer in the invention, the content of water-soluble components that exhibit water solubility when the self-dispersing polymer is in a dispersed state is preferably 10% by mass or less, more preferably 8% by mass or less, and still more preferably 6% by mass or less. When the content of the water-soluble components is 10% by mass or less, swelling of polymer particles and adhesion between polymer particles may be effectively prevented, and a more stable dispersed state may be maintained; further, an increase in viscosity of the ink composition may be suppressed, and, when the ink composition is applied to, for example, an inkjet method, ejection stability is improved.

Here, the term "water-soluble components" refers to compounds that are contained in the self-dispersing polymer and that dissolve in water when the self-dispersing polymer is in a dispersed state. The water-soluble components are water-soluble compounds that are generated as by-products or incorporated during the preparation of the self-dispersing polymer.

The self-dispersing polymer may include at least one kind of hydrophilic structural unit derived from a hydrophilic monomer and at least one kind of hydrophobic structural unit derived from a hydrophobic monomer. The main chain skeleton of the self-dispersing polymer is not particularly limited, and is preferably a vinyl polymer, more preferably a (meth) acrylic polymer, from the viewpoint of dispersion stability of the polymer particles. The term "(meth)acrylic polymer refers to a polymer containing at least one of a structural unit derived from a methacrylic acid derivative or a structural unit derived from an acrylic acid derivative.

Hydrophilic Structural Unit

The hydrophilic structural unit is not particularly limited as long as the hydrophilic structural unit derives from a hydrophilic-group-containing monomer (hydrophilic monomer). The hydrophilic structural units of the self-dispersing polymer may be derived from only one kind of hydrophilic-group-containing monomer or from two or more kinds of hydrophilic-group-containing monomer. The hydrophilic group is not particularly limited, and may be a dissociative group or a nonionic hydrophilic group.

The hydrophilic groups of the hydrophilic structural units of the self-dispersing polymer preferably include at least one kind of dissociative group, more preferably include an anionic dissociative group, from the viewpoints of enhancing self-dispersibility and improving stability of the emulsified or dispersed state obtained. Examples of the anionic dissociative group include a carboxyl group, a phosphoric acid group, and a sulfonic acid group. A carboxyl group is particularly preferable from the viewpoint of the fixability of an ink composition.

The hydrophilic-group-containing monomer is preferably a dissociative-group-containing monomer, and more preferably a dissociative-group-containing monomer having a dissociative group and an ethylenic unsaturated bond, from the viewpoint of self-dispersibility. Examples of the dissociative-group-containing monomer include an unsaturated carboxylic acid monomer, an unsaturated sulfonic acid monomer, and an unsaturated phosphoric acid monomer.

Examples of the unsaturated carboxylic acid monomer include acrylic acid, methacrylic acid, crotonic acid, itaconic acid, maleic acid, fumaric acid, citraconic acid, and 2-methacryloyloxyethylsuccinic acid. Examples of the unsaturated sulfonic acid monomer include styrenesulfonic acid, 2-acrylamide-2-methylpropane sulfonic acid, 3-sulfopropyl (meth) acrylate, and bis-(3-sulfopropyl) itaconate. Examples of the unsaturated phosphoric acid monomer include vinyl phosphonic acid, vinyl phosphate, bis(methacryloxyethyl) phosphate, diphenyl-2-acryloyloxyethyl phosphate, diphenyl-2-methacryloyloxyethyl phosphate, and dibutyl-2-acryloyloxyethyl phosphate.

Among the above dissociative-group-containing monomers, unsaturated carboxylic acid monomers are preferable, and at least one of acrylic acid or methacrylic acid is more preferable, in consideration of dispersion stability and ejection stability.

Examples of monomers having a nonionic hydrophilic group include: 2-methoxyethyl acrylate; 2-(2-methoxyethoxy)ethyl acrylate; 2-(2-methoxyethoxy)ethyl methacrylate; ethylenic unsaturated monomers containing a (poly) ethyleneoxy group or a polypropyleneoxy group such as ethoxytriethyleneglycol methacrylate, methoxypolyethyleneglycol (molecular weight: from 200 to 1,000) monomethacrylate, polyethyleneglycol (molecular weight: from 200 to 1,000) monomethacrylate; and ethylenic unsaturated monomers having a hydroxyl group such as hydroxymethyl (meth)acrylate, 2-hydroxyethyl (meth)acrylate, 2-hydroxypropyl (meth)acrylate, 4-hydroxybutyl (meth) acrylate, hydroxypentyl (meth)acrylate, and hydroxyhexyl (meth)acrylate.

Ethylenic unsaturated monomers terminated with an alkyl ether are more preferable examples of monomers having a nonionic hydrophilic group than ethylenic unsaturated monomers terminated with a hydroxyl group, from the viewpoints of stability of the particles and the content of water-soluble components.

Regarding the hydrophilic structural unit in the invention, it is preferable that the self-dispersing polymer includes only at least one hydrophilic structural unit each having an anionic dissociative group or include both of (i) at least one hydrophilic structural unit each having an anionic dissociative group and (ii) at least one hydrophilic structural unit each having a nonionic hydrophilic group.

It is also preferable that the self-dispersing polymer includes two or more kinds of hydrophilic structural unit having an anionic dissociative group, or that the self-dispersing polymer includes a hydrophilic structural unit having an anionic dissociative group and two or more kinds of hydrophilic structural unit having a nonionic hydrophilic group.

The content of hydrophilic structural units in the self-dispersing polymer is preferably 25% by mass or less, more preferably from 1% by mass to 25% by mass, still more preferably from 2% by mass to 23% by mass, and particularly preferably from 4% by mass to 20% by mass, from the viewpoints of viscosity and temporal stability.

When the self-dispersing polymer includes two or more kinds of hydrophilic structural unit, the total content of the hydrophilic structural units is preferably within the above range.

The content of hydrophilic structural units each having an anionic dissociative group in the self-dispersing polymer is preferably such that the acid value is within the preferable range described below.

The content of structural units each having a nonionic hydrophilic group is preferably from 0% by mass to 25% by mass, more preferably from 0% by mass to 20% by mass, and particularly preferably from 0% by mass to 15% by mass, from the viewpoints of ejection stability and temporal stability.

When the self-dispersing polymer has an anionic dissociative group, the acid value thereof (in terms of mgKOH/g) is preferably from 50 mgKOH/g to 75 mgKOH/g, more preferably from 52 mgKOH/g to 75 mgKOH/g, and still more preferably from 55 mgKOH/g to 72 mgKOH/g, from the viewpoints of self-dispersibility, the content of water-soluble components, and fixability of an ink composition. The acid value is particularly preferably from 60 mgKOH/g to 70 mgKOH/g. An acid value of 50 mgKOH/g or higher improves ejection response and ejectability maintenance properties of an ink composition containing the self-dispersing polymer. An acid value of 75 mgKOH/g or lower tend to increase viscosity and improve blocking resistance.

Hydrophobic Structural Unit

The hydrophobic structural unit in the invention is not particularly limited as long as the unit is derived from a hydrophobic-group-containing monomer (hydrophobic monomer). The hydrophobic structural units of the self-dispersing polymer may be derived from only one kind of hydrophobic-group-containing monomer, or from two or more kinds of hydrophobic-group-containing monomer. The hydrophobic group is not particularly limited, and may be a chain aliphatic group, a cyclic aliphatic group, or an aromatic group.

In the invention, the hydrophobic structural units of the self-dispersing polymer preferably include at least one kind of cyclic-aliphatic-group-containing monomer, and more preferably include a (meth)acrylate containing a cyclic aliphatic group (hereinafter referred to as "alicyclic (meth)acrylate" in some cases), from the viewpoints of a high Tg, blocking resistance, abrasion resistance, and dispersion stability.

The term "alicyclic (meth)acrylate" refers to a compound which includes a moiety derived from (meth)acrylic acid and a moiety derived from an alcohol (hereinafter referred to as alcohol-derived moiety in some cases), and has at least one substituted or unsubstituted alicyclic hydrocarbon group at the moiety derived from an alcohol. The alicyclic hydrocarbon group may be the alcohol-derived moiety itself, or may be bonded to a moiety derived from an alcohol via a linking group. The alicyclic (meth)acrylate is a methacrylate or acrylate having an alicyclic hydrocarbon group.

The alicyclic hydrocarbon group is not particularly limited as long as it contains a cyclic non-aromatic hydrocarbon group. Examples thereof include monocyclic hydrocarbon groups, bicyclic hydrocarbon groups, and polycyclic hydrocarbon groups having three or more rings. Examples of alicyclic hydrocarbon groups include a cycloalkyl group such as a cyclopentyl group or a cyclohexyl group, a cycloalkenyl group, a bicyclohexyl group, a norbornyl group, an isobornyl group, a dicyclopentanyl group, a dicyclopentenyl group, an adamantyl group, a decahydronaphthalenyl group, a perhydrofluorenyl group, a tricyclo[5.2.1.$0^{2,6}$]decanyl group, and a bicyclo[4.3.0]nonyl group.

The alicyclic hydrocarbon group may have a substituent. Examples of the substituent include an alkyl group, an alkenyl group, an aryl group, an aralkyl group, an alkoxy group, a hydroxyl group, a primary amino group, a secondary amino group, a tertiary amino group, an alkylcarbonyl group, an arylcarbonyl group, and a cyano group.

The alicyclic hydrocarbon group may include a condensed ring.

The number of carbons in the alicyclic hydrocarbon group in the invention is preferably from 5 to 20 from the viewpoints of viscosity and solubility.

Preferable examples of the linking group that connects the alicyclic hydrocarbon group and the moiety derived from an alcohol include an alkyl group, an alkenyl group, an alkylene group, an aralkyl group, an alkoxy group, a monoethyleneglycol group, an oligoethyleneglycol group, a monopropyleneglycol group, and an oligopropyleneglycol group, each of which has from 1 to 20 carbon atoms.

Specific examples of the alicyclic (meth)acrylate include, but are not limited to, the following.

Examples monocyclic (meth)acrylates include a cycloalkyl (meth)acrylate of which cycloalkyl group has from 3 to 10 carbon atoms, such as cyclopropyl (meth)acrylate, cyclobutyl (meth)acrylate, cyclopentyl (meth)acrylate, cyclohexyl (meth)acrylate, cycloheptyl (meth)acrylate, cyclooctyl (meth)acrylate, cyclononyl (meth)acrylate, or cyclodecyl (meth)acrylate.

Examples of bicyclic (meth)acylates include isobornyl (meth)acrylate and norbornyl (meth)acrylate.

Examples of tricyclic (meth)acrylates include adamantyl (meth)acrylate, dicyclopentanyl (meth)acrylate, and dicyclopentenyloxyethyl (meth)acrylate.

The alicyclic (meth)acrylate may be used singly, or two or more alicyclic (meth)acrylates may be used in mixture.

The self-dispersing polymer preferably includes hydrophobic structural units derived from at least one alicyclic (meth)acrylate selected from bicyclic (meth)acrylates and polycyclic (meth)acrylates having three or more rings, and more preferably includes hydrophobic structural units derived from at least one of isobornyl (meth)acrylate, adamantyl (meth)acrylate, or dicyclopentanyl (meth)acrylate, from the viewpoints of the dispersion stability of the self-dispersing polymer particles, fixability, and blocking resistance.

In the invention, the content ratio of alicyclic (meth)acrylate-derived structural units contained in the self-dispersing polymer particles is preferably from 20% by mass to 90% by mass, and more preferably from 40% by mass to 90% by mass, from the viewpoints of improving the stability of the self-dispersing state, enhancing the stability of the particle shape in an aqueous medium through hydrophobic interactions between alicyclic hydrocarbon groups, and decreasing the amount of water-soluble components by an appropriate degree of hydrophobization of the particles. The content ratio of alicyclic (meth)acrylate-derived structural units contained in the self-dispersing polymer particles is particularly preferably from 50% by mass to 80% by mass.

Fixability and blocking resistance are improved by adjusting the content ratio of alicyclic (meth)acrylate-derived structural units to 20% by mass or higher. The stability of the polymer particles is improved by adjusting the content ratio of alicyclic (meth)acrylate-derived structural units to 90% by mass or lower.

As necessary, the self-dispersing polymer in the invention may further include other additional structural units as hydrophobic structural units, in addition to the alicyclic (meth) acrylate-derived structural units. The monomers for forming the additional structural units are not particularly limited as long as they are copolymerizable with the alicyclic (meth) acrylate and the hydrophilic-group-containing monomer, and may be a known monomer.

Specific examples of monomers for forming the additional structural units (hereinafter referred to as other copolymerizable monomers or additional copolymerizable monomers) include: alkyl (meth)acrylates such as methyl (meth)acrylate, ethyl (meth)acrylate, isopropyl (meth)acrylate, n-propyl (meth)acrylate, n-butyl (meth)acrylate, isobutyl (meth)acrylate, t-butyl (meth)acrylate, hexyl (meth)acrylate, and ethylhexyl (meth)acrylate; aromatic-ring-containing (meth)acrylates such as benzyl (meth)acrylate and phenoxyethyl (meth) acrylate; styrenes such as styrene, α-methylstyrene, and chlorostyrene; dialkylaminoalkyl (meth)acrylates such as dimethylaminoethyl (meth)acrylate; and (meth)acrylamides such as N-hydroxyalkyl (meth)acrylamides (such as N-hydroxymethyl (meth)acrylamide, N-hydroxyethyl (meth) acrylamide, and N-hydroxybutyl (meth)acrylamide) and N-alkoxyalkyl (meth)acrylamides (such as N-methoxymethyl (meth)acrylamide, N-ethoxymethyl (meth)acrylamide, N-(n-/iso)butoxymethyl (meth)acrylamide, N-methoxyethyl (meth)acrylamide, N-ethoxyethyl (meth)acrylamide, and N-(n-/iso)butoxyethyl (meth)acrylamide).

The additional copolymerizable monomers preferably is at least one (meth)acrylate containing a chain alkyl group having from 1 to 8 carbon atoms, more preferably a (meth) acrylate having a chain alkyl group having from 1 to 4 carbon atoms, and particularly preferably methyl (meth)acrylate and/or ethyl (meth)acrylate, from the viewpoints of ease of controlling the flexibility of polymer skeleton and glass transition temperature (Tg) and dispersion stability of the self-dispersing polymer. Here, the chain alkyl group refers to an alkyl group having a linear chain or a branched chain.

In the invention, use of a (meth)acrylate containing an aromatic group is also preferable.

When one or more aromatic-group-containing (meth)acrylates are contained as additional copolymerizable monomers, the content ratio of structural units derived from aromatic-group-containing (meth)acrylates is preferably 40% by mass or lower, more preferably 30% by mass or lower, and particularly preferably 20% by mass or lower, from the viewpoint of the dispersion stability of the self-dispersing polymer particles.

When one or more styrenic monomers are used as additional copolymerizable monomers, the content ratio of structural units derived from styrenic monomers is preferably 20% by mass or lower, more preferably 10% by mass or lower, and still more preferably 5% by mass or lower, from the viewpoint of the dispersion stability of the self-dispersing polymer particles. It is particularly preferable that the self-dispersing polymer does not include a structural unit derived from a styrenic monomer, from the viewpoint of the dispersion stability of the self-dispersing polymer particles.

Here, the term "styrenic monomer" encompasses styrene, substituted styrenes (α-methylstyrene, chlorostyrene, etc.), and styrene macromers having a polystyrene structural unit.

In the invention, an additional polymerizable monomer may be used singly, or two or more additional polymerizable monomers may be used in combination.

When the self-dispersing polymer includes additional structural units, the content thereof is preferably from 10% by mass to 80% by mass, more preferably from 15% by mass to 75% by mass, and particularly preferably from 20% by mass to 70% by mass. When two or more monomers for forming additional structural units are used in combination, the total content thereof is preferably within the above range.

The self-dispersing polymer in the invention is preferably a polymer obtained by copolymerization of at least three monomers including an alicyclic (meth)acrylate, an additional copolymerizable monomer, and a hydrophilic-group-containing monomer, and is more preferably a polymer obtained by copolymerization of at least three monomers including an alicyclic (meth)acrylate, an alkyl-group-containing (meth)acrylate having a C1 to C8 linear or branched chain, and a hydrophilic-group-containing monomer, from the viewpoint of dispersion stability.

In the invention, from the viewpoint of dispersion stability, it is preferable that the self-dispersing polymer does not substantially include a structural unit having a highly-hydrophobic substituent derived from a (meth)acrylate having a linear or branched chain alkyl group having 9 or more carbon atoms or from an aromatic-group-containing macromonomer, and it is more preferable that the self-dispersing polymer does not include a structural unit having a highly-hydrophobic substituent derived from a (meth)acrylate having a linear or branched chain alkyl group having 9 or more carbon atoms or from an aromatic-group-containing macromonomer, at all.

The self-dispersing polymer in the invention may be a random copolymer in which respective kinds of structural unit are introduced irregularly, or a block copolymer in which respective kinds of structural unit are introduced regularly. When the self-dispersing polymer is a block copolymer, the block copolymer may be synthesized by introducing the respective kinds of structural unit thereof in any order, and a same kind of constituent component may be used more than once. The self-dispersing polymer is preferably a random copolymer from the viewpoints of versatility and productivity.

The molecular weight range of the self-dispersing polymer, in terms of weight average molecular weight, is preferably from 3,000 to 200,000, and more preferably from 10,000 to 200,000, and still more preferably from 30,000 to 150,000. A weight average molecular weight of 3,000 or more effectively may reduce the amount of water-soluble components. A weight average molecular weight of 200,000 or less may enhance self-dispersing stability.

The weight average molecular weight is measured with a gel permeation chromatograph (GPC).

The self-dispersing polymer preferably has an acid value of from 50 mgKOH/g to 75 mgKOH/g, more preferably from 52 mgKOH/g to 75 mgKOH/g, still more preferably from 55 mgKOH/g to 72 mgKOH/g, and particularly preferably from 60 mgKOH/g to 70 mgKOH/g, from the viewpoints of viscosity control, ejection response, and ejectability maintenance properties of the ink composition.

An acid value of 50 mgKOH/g or higher may improve ejection response and ejectability maintenance properties of an ink composition containing the self-dispersing polymer, an acid value of 75 mgKOH/g or lower tends to increase viscosity.

The acid value can be measured according to the method described in JIS standard (JIS K0070: 1992), the disclosure of which is incorporated by reference herein.

The self-dispersing polymer preferably has a neutralization degree of from 40 to 60%, more preferably from 45 to 55%, and particularly preferably from 47 to 53%, from the viewpoints of viscosity control, ejection response, and ejectability maintenance properties.

A neutralization degree of the self-dispersing polymer of 40% or higher increases viscosity and improves ejection response. A neutralization degree of the self-dispersing polymer of 60% or lower improves ejectability maintenance properties.

A neutralization degree of from 40% to 60% may be advantageous in manufacturing the self-dispersing polymer stably.

As used in the invention, the term "neutralization degree" refers to the amount of alkali, in terms of % by mol, that is added during the preparation of a self-dispersing polymer, assuming that the amount of the dissociative groups contained in the self-dispersing polymer chain is 100% by mol.

In regard to the combination of the acid value and neutralization degree of the self-dispersing polymer, it is preferable that the acid value is from 52 mgKOH/g to 75 mgKOH/g and the neutralization degree is from 45 to 55%, and it is more preferable that the acid value is from 55 mgKOH/g to 72 mgKOH/g and the neutralization degree is from 45 to 55%, and it is still more preferable that the acid value is from 55 mgKOH/g to 65 mgKOH/g and the neutralization degree is from 47 to 53%.

From the viewpoint of hydrophilicy-hydrophobicity control of the polymer, the self-dispersing polymer in the invention is preferably a vinyl polymer which includes at least one type of structure unit derived from an alicyclic (meth)acrylate at a total copolymerization ratio of from 20% by mass to 90% by mass, at least one type of structure unit derived from a dissociative-group-containing monomer, and at least one type of structure unit derived from a (meth)acrylate containing a C1 to C8 chain alkyl group, and which has an acid value of from 20 to 120 and a weight average molecular weight of from 3,000 to 200,000, and in which the total content of hydrophilic structural units is 25% by mass or lower, more preferably a vinyl polymer which includes at least one type of structure unit derived from a bicyclic or polycyclic (tri- or higher-cyclic) (meth)acrylate at a total copolymerization ratio of from 20% by mass to less than 90% by mass, at least one type of structure unit derived from a (meth) acrylate containing a C1 to C4 chain alkyl group at a total copolymerization ratio of from 10% by mass to less than 80% by mass, and at least one type of structure unit derived from a carboxyl-group-containing monomer at such a total copolymerization ratio that the acid value of the self-dispersing polymer is from 50 mgKOH/g to 75 mgKOH/g, and which has a weight average molecular weight of from 10,000 to 200,000, and in which the total content of hydrophilic structural units is 25% by mass or lower, and particularly preferably a vinyl polymer which includes at least one type of structure unit derived from a bicyclic or polycyclic (tri- or higher-cyclic) (meth)acrylate at a total copolymerization ratio of from 40% by mass to less than 80% by mass, at least one type of structure unit derived from methyl (meth)acrylate or ethyl (meth)acrylate at a total copolymerization ratio of from 20% by mass to less than 60% by mass, and at least one type of structure derived from acrylic acid or methacrylic acid at such a total copolymerization ratio that the acid value of the self-dispersing polymer is from 50 mgKOH/g to 75 mgKOH/g, and which has a weight average molecular weight of from 30,000 to 150,000, and in which the total content of hydrophilic structural units is 25% by mass or lower.

In the present invention, the resin particle (particularly, self-dispersing polymer particle) has a glass transition temperature (Tg) of 100° C. or higher. When the Tg is lower than 100° C., even if the cooling process described below is provided, the effect sufficient for preventing the occurrence of stacker blocking after image formation cannot be expected. From the viewpoint of prevention of occurrence of stacker blocking, the Tg is preferably 150° C. or higher, more preferably from 160° C. to 250° C., and even more preferably from 160° C. to 200° C.

The Tg of the resin particle can be appropriately adjusted by a generally used method. For example, the Tg of the resin particle can be adjusted to be within a desired range by appropriately selecting the kind of polymerizable group of a monomer that is used for forming the resin particle, the kinds and constitutional ratio of the substituents on the monomer, the molecular weight of a polymer molecule that forms the resin particle, or the like. It should be noted that, for Tg, "a measured Tg" that can be obtained by actual measurement is applied, however, in a case in which measurement is difficult due to decomposition of the polymer or the like, "a calculated Tg" that is calculated according to the equation described below is applied.

Specifically, the "measured Tg" is a value measured by using a differential scanning calorimeter (DSC) EXSTAR6220 (trade name), manufactured by SII Nanotechnology, Inc., under general measurement conditions. Further, the "calculated Tg" is a value calculated using a Tg value of a homopolymer of a monomer in accordance with the following Equation (1).

$$1/Tg=\Sigma(X_i/Tg_i) \quad \text{Equation (1)}$$

In Equation (1) above, it is assumed that, in the polymer serving as the object of the calculation, n kinds of monomer components, with i being from 1 to n, are copolymerized. $X_i$ represents the weight fraction of $i^{th}$ monomer ($\Sigma X_i=1$), and $Tg_i$ represents the glass transition temperature (absolute temperature) of a homopolymer of the $i^{th}$ monomer. Σ takes the sum of i=1 to i=n. Moreover, for the value of the glass transition temperature ($Tg_i$) of a homopolymer of each monomer, a value given in Polymer Handbook (3rd Edition) (edited by J. Brandrup, E. H. Immergut (Wiley-Interscience, 1989)) is employed.

In the following, specific examples of the self-dispersing polymer are shown. However, it should be construed that the invention is not limited thereto. The numbers in parenthesis represent the mass ratio of the copolymerized components.

Methyl methacrylate/isobornyl methacrylate/methacrylic acid copolymer (=20/72/8), glass transition temperature: 180° C., acid value: 52.1

Methyl methacrylate/isobornyl methacrylate/methacrylic acid copolymer (=40/52/8), glass transition temperature: 160° C., acid value: 52.1

Methyl methacrylate/isobornyl methacrylate/methacrylic acid copolymer (=38/52/10), glass transition temperature: 160° C., acid value: 65.1

Methyl methacrylate/isobornyl methacrylate/methacrylic acid copolymer (=42/52/6), glass transition temperature: 161° C., acid value: 39.1

Methyl methacrylate/isobornyl methacrylate/methacrylic acid copolymer (=64/26/10), glass transition temperature: 140° C.

Methyl methacrylate/isobornyl methacrylate/methacrylic acid copolymer (=36.5/52/11.5), glass transition temperature: 160° C., acid value: 74.8

Methyl methacrylate/isobornyl methacrylate/methacrylic acid copolymer (=36/52/12), glass transition temperature: 160° C., acid value: 78.1

Methyl methacrylate/isobornyl methacrylate/dicyclopentanyl methacrylate/methacrylic acid copolymer (=20/62/10/8), glass transition temperature: 170° C., acid value: 52.1

Methyl methacrylate/dicyclopentanyl methacrylate/methacrylic acid copolymer (=20/72/8), glass transition temperature: 160° C., acid value: 52.1

Methyl methacrylate/dicyclopentanyl methacrylate/methacrylic acid copolymer (=18/72/10), glass transition temperature: 161° C., acid value: 65.1

Methyl methacrylate/PME-100/isobornyl methacrylate/methacrylic acid copolymer (=44/20/26/10), glass transition temperature: 110° C.

(PME-100: BLEMMER PME-100 (trade name), manufactured by NOF Corporation)

The method for preparing a self-dispersing polymer in the invention is not particularly limited, and the self-dispersing polymer can be prepared by copolymerizing a monomer mixture according to a known polymerization method. Among polymerization methods, polymerization in an organic medium is preferable, and a solution polymerization method is particularly preferable, from the viewpoint of ejection stability of an ink composition containing the self-dispersing polymer.

In the method for preparing a self-dispersing polymer of the invention, a self-dispersing polymer may be prepared by subjecting a mixture containing a monomer mixture and, optionally, an organic solvent and/or a radical polymerization initiator to a copolymerization reaction under an inactive gas atmosphere.

The method for producing an aqueous dispersion of self-dispersing polymer particles in the invention is not particularly limited, and an aqueous dispersion of self-dispersing polymer particles may be produced according to a known method. A process of obtaining an aqueous dispersion of self-dispersing polymer is preferably a phase inversion emulsification method that includes the following processes (1) and (2):

Process (1): a step of agitating a mixture containing a self-dispersing polymer, an organic solvent, a neutralizing agent, and an aqueous medium Process (2): a step of removing at least a part of the organic solvent from the resultant dispersion The process (1) is preferably a process in which the self-dispersing polymer is dissolved in the organic solvent, and then the neutralizing agent and the aqueous medium are gradually added to the polymer solution and mixed, by agitation, with the polymer solution to form a dispersion. When the neutralizing agent and the aqueous medium are added to the self-dispersing polymer solution in which the self-dispersing polymer is dissolved in the organic solvent, self-dispersing polymer particles of which diameter is highly stable during storage can be obtained without requiring a strong shearing force.

The method of agitating the mixture is not particularly limited, and may be a method using a generally-used mixing and agitating apparatus and/or, if necessary, a disperser such as an ultrasonic disperser or a high-pressure homogenizer.

Preferable examples of the organic solvent include an alcohol solvent, a ketone solvent, and an ether solvent. Examples of the alcohol solvent include isopropyl alcohol, n-butanol, t-butanol, and ethanol. Examples of the ketone solvent include acetone, methyl ethyl ketone, diethyl ketone, and methyl isobutyl ketone. Examples of the ether solvent include dibutyl ether and dioxane. Among the above solvents, ketone solvents such as methyl ethyl ketone and alcohol solvents such as isopropyl alcohol are preferable. It is also preferable to use isopropyl alcohol and methyl ethyl ketone together; using the solvents together makes it possible to obtain self-dispersing polymer particles having a very small particle diameter that are free from aggregation precipitation or adhesion between particles and that have high dispersion stability. The reasons for exerting these effects are thought to include, for example, a milder polarity change at the time of phase inversion from an oil phase to an aqueous phase.

The neutralizing agent is used to neutralize all or some of the dissociative groups of the self-dispersing polymer so as to allow the self-dispersing polymer particles to get into a stable emulsified or dispersed state in water. When the self-dispersing polymer has an anionic dissociative group as a dissociative group, the neutralizing agent to be used may be a basic compound such as an organic amine compound, ammonia, or an alkali metal hydroxide. Examples of the organic amine compound include monomethylamine, dimethylamine, trimethylamine, monoethylamine, diethylamine, triethylamine, monopropylamine, dipropylamine, monoethanolamine, diethanolamine, triethanolamine, N,N-dimethyl-ethanolamine, N,N-diethyl-ethanolamine, 2-dimethylamino-2-methyl-1-propanol, 2-amino-2-methyl-1-propanol, N-methyldiethanolamine, N-ethyldiethanolamine, monoisopropanolamine, diisopropanolamine, and triisopropanolamine. Examples of the alkali metal hydroxide include lithium hydroxide, sodium hydroxide, and potassium hydroxide. Among them, sodium hydroxide, potassium hydroxide, triethylamine, and triethanolamine are preferable from the viewpoint of stabilizing the dispersed state of the self-dispersing polymer particles of the invention in water.

In the process (2), the organic solvent is removed from the dispersion obtained by the process (1) using a common method such as distillation under reduced pressure, whereby phase inversion into an aqueous system occurs and an aqueous dispersion of the self-dispersing polymer particles is obtained. The organic solvent has substantially been removed from the obtained aqueous dispersion, and the amount of the remaining organic solvent is preferably 0.2% by mass or less, and more preferably 0.1% by mass or less.

The volume average particle diameter (hereinafter simply referred to as "average particle diameter" in some cases) of the self-dispersing polymer particles in the invention is preferably in the range of from 0.1 nm to 10 nm. The above particle diameter range is preferable in that an average particle diameter of 0.1 nm or more increases production suitability and ejectability maintenance properties, and that an average particle diameter of 10 nm or less improves storage stability and ink viscosity increasing effects.

Within the above average particle diameter range, an average particle diameter of from 0.5 nm to 8 nm is preferable, an average particle diameter of from 1 nm to 7 nm is more preferable, an average particle diameter of from 1 nm to 5 nm is still more preferable, and an average particle diameter of from 1 nm to 4 nm is particularly preferable, in view of viscosity increase and ejection properties (such as ejection response and ejectability maintenance properties). When the self-dispersing polymer exerts viscosity increasing effects as well as self-dispersibility, the amount of thickener to be added can resultantly be decreased, and ejection response can thus be improved.

The particle diameter distribution of the self-dispersing polymer particles is not particularly limited, and may have a broad particle diameter distribution or a monodispersed particle diameter distribution. Two or more types of water-insoluble particles may be used in mixture.

The average particle diameter and particle diameter distribution of the self-dispersing polymer particles can be measured using, for example, a light scattering method.

It is preferable that the self-dispersing polymer particles in the ink composition of the invention do not substantially contain a colorant.

The self-dispersing polymer particles in the invention have excellent self-dispersibility, and the stability observed when the self-dispersing polymer particles are dispersed alone is remarkably high. However, the self-dispersing polymer particles do not have high capability as, for example, a dispersant, which stably disperses a pigment. Therefore, when the self-dispersing polymer particles in the invention contains a pigment and are present in the ink composition, the stability of the entire ink composition may resultantly be greatly lowered in some cases.

The ink composition of the invention may include self-dispersing polymer particles of only one type, or a mixture of two or more types of self-dispersing polymer particles.

The content of self-dispersing polymer particles in the ink composition of the invention is preferably from 1% by mass to 30% by mass, more preferably from 2% by mass to 20% by mass, and particularly preferably from 2% by mass to 10% by mass, with respect to the total mass of the ink composition, from the viewpoint of image gloss and the like.

In the ink composition of the invention, the content ratio of pigment to resin particles (especially, self-dispersing polymer particles) (pigment/resin particles) is preferably in the range of from 1/0.5 to 1/10, and more preferably in the range of from 1/1 to 1/4, from the viewpoint of, for example, abrasion resistance of an image.

Water-Soluble Organic Solvent

The ink composition according to the present invention may include at least one water-soluble organic solvent. Note that, the term "water-soluble" means that 1 g or more of the solvent dissolves in 100 g of water (at 25° C.).

The water-soluble organic solvent can provide effects as anti-drying agents, wetting agents, or permeation accelerators. In order to prevent drying, a water-soluble organic solvent is used as an anti-drying agent to prevent clogging of discharge nozzles, which may possibly caused due to aggregates generated by adhesion and drying of an ink at an ink discharge port. For the purpose of anti-drying and wetting, a water-soluble organic solvent which has a vapor pressure lower than that of water is preferable. Further, in order to accelerate permeation, a water-soluble organic solvent can be used as a permeation accelerator to enhance permeability of ink into paper.

Examples of the water-soluble organic solvent include alkanediols (polyhydric alcohols) such as glycerin, 1,2,6-hexanetriol, trimethylolpropane, ethylene glycol and propylene glycol; sugars such as glucose, mannose and fructose; sugar alcohols; hyaluronic acids; alkyl alcohols having 1 to 4 carbon atoms such as ethanol, methanol, butanol, propanol and isopropanol; glycol ethers such as ethylene glycol monomethyl ether, ethylene glycol monoethyl ether, ethylene glycol monobutyl ether, ethylene glycol monomethyl ether acetate, diethylene glycol monomethyl ether, diethylene glycol monoethyl ether, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-t-butyl ether, 1-methyl-1-methoxybutanol, propylene glycol monomethyl ether, propylene glycol monoethyl ether, propylene glycol mono-t-butyl ether, propylene glycol mono-n-propyl ether, propylene glycol mono-iso-propyl ether, dipropylene glycol monomethyl ether, dipropylene glycol monoethyl ether, tripropylene glycol monomethyl ether, dipropylene glycol mono-n-propyl ether and dipropylene glycol mono-iso-propyl ether. One kind or two or more kinds thereof can be employed.

For applications to the anti-drying agent and the wetting agent, polyhydric alcohols are useful and examples thereof include glycerin, ethylene glycol, diethylene glycol, triethylene glycol, propylene glycol, dipropylene glycol, tripropylene glycol, 1,3-butanediol, 2,3-butanediol, and the like. They may be used in one kind alone, or in two or more kinds in combination.

For the application to the penetration agent, polyol compounds are preferable. Examples of aliphatic diols include 2-ethyl-2-methyl-1,3-propanediol, 3,3-dimethyl-1,2-butanediol, 2,2-diethyl-1,3-propanediol, 2-ethyl-1,3-hexanediol, 2,2,4-trimethyl-1,3-pentanediol can be mentioned as preferable examples. Among these, more preferable examples include 2-ethyl-1,3-hexanediol and 2,2,4-trimethyl-1,3-pentanediol.

As to the water-soluble organic solvent, it is preferable that the ink composition contains a water-soluble solvent having an SP (solubility parameter) value of 27.5 or less in view of suppressing the occurrence of curling of the recording medium. When a water-soluble solvent having an SP (solubility parameter) value of 27.5 or less is used, the occurrence of curling under various environmental humidity conditions after recording may be further suppressed.

Note that, the SP value (solubility parameter) is a value expressed by the square root of the cohesive energy of molecules. SP values are calculated according to the method described in R. F. Fedors, Polymer Engineering Science, 14, pages 147 to 154 (1974), the disclosure of which is incorporated by reference herein.

Above all, a water-soluble organic solvent which is represented by the following Formula (1) and has a molecular weight of from 240 to 1400 is more preferable.

$$R\text{-}A_n\text{-}OH \qquad \text{Formula (1)}$$

In Formula (1) above, R represents a hydrogen atom, an alkyl group having from 1 to 4 carbon atoms (for example, a methyl group, an ethyl group, a propyl group, a butyl group, or the like), or a group derived from a sugar alcohol having from 3 to 12 carbon atoms. From the viewpoint of the curling suppressing effect, R is preferably an alkyl group having from 1 to 4 carbon atoms or a group derived from a sugar alcohol having from 3 to 6 carbon atoms.

Here, the group derived from a sugar alcohol means a group formed by removing at least one hydroxyl group from sugar alcohol. The position of the hydroxyl group which is removed from sugar alcohol is not particularly limited, and the group may be a group having a valency of two or more obtained by removing two or more hydroxyl groups. The water-soluble organic solvent may be a mixture of two or more formed by removing (a) hydroxyl group(s) from different positions in the sugar alcohol molecule.

In Formula (1), A represents at least one selected from the group consisting of an ethyleneoxy group and a propyleneoxy group. n represents an integer of from 3 to 24.

Specific examples of the water-soluble organic solvent represented by Formula (1) above may include GP-250 (trade name, manufactured by Sanyo Chemical Industries, Ltd.), GP-400 (trade name, manufactured by Sanyo Chemical Industries, Ltd.), 50HB-55 (trade name, manufactured by Sanyo Chemical Industries, Ltd.), 50HB-100 (trade name, manufactured by Sanyo Chemical Industries, Ltd.), 50HB-260 (trade name, manufactured by Sanyo Chemical Industries, Ltd.), SC-P400 (trade name, manufactured by Sakamoto Yakuhin Kogyo Co., Ltd.), and SC-E2000 (trade name, manufactured by Sakamoto Yakuhin Kogyo Co., Ltd.).

When the molecular weight is 240 or more, it is useful in view of the curling suppressing effect, and when the molecular weight is 1400 or less, it is useful in view of ink ejection stability. Above all, it is more preferable that the molecular weight of a water-soluble organic solvent having an SP value of 27.5 or less is in a range of from 250 to 800.

Among the water-soluble organic solvents having an SP value of 27.5 or less, a compound represented by the following Structural formula (I) is particularly preferable in view of suppressing the occurrence of curling after recording.

Structural Formula (1)

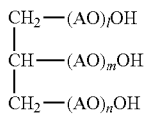

In Structural formula (1), l, m, and n each independently represent an integer of 1 or more, and l, m, and n satisfy l+m+n=3 to 15. When the value of l+m+n is 3 or more, the curling suppressing effect may be satisfactory, and when the value of l+m+n is 15 or less, a good ejectability may be maintained.

Among them, l+m+n is preferably in a range of from 3 to 12, and more preferably in a range of from 3 to 10.

In Structural formula (1), AO represents ethyleneoxy (which may be abbreviated to EO) and/or propyleneoxy (which may be abbreviated to PO). AO preferably represents propyleneoxy. AOs in each of $(AO)_1$, $(AO)_m$, and $(AO)_n$ may be the same as or different from each other.

Examples of the water-soluble organic solvent having an SP value of 27.5 or less and examples of the compound represented by the above Structural formula (I) are shown below. Note that, the number in parenthesis represents the SP value. However, the present invention is not limited to these examples.

Diethylene glycol monoethyl ether (22.4)
Diethylene glycol monobutyl ether (21.5)
Triethylene glycol monobutyl ether (21.1)
Dipropylene glycol monomethyl ether (21.3)
Dipropylene glycol (27.2)

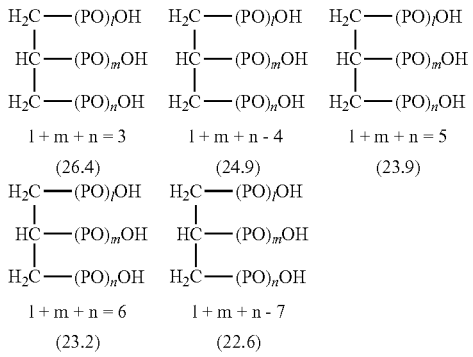

$nC_4H_9O(AO)_4$—H
(AO=EO or PO (EO:PO=1:1), SP value=20.1)
$nC_4H_9O(AO)_{10}$—H
(AO=EO or PO (EO:PO=1:1), SP value=18.8)
$HO(A'O)_{40}$—H
(A'O=EO or PO (EO:PO=1:3), SP value=18.7)
$HO(A''O)_{55}$—H
(A"O=EO or PO (EO:PO=5:6), SP value=18.8)
$HO(PO)_3$—H(SP value=24.7)
$HO(PO)_7$—H(SP value=21.2)
1,2-hexanediol (SP value=27.4)

The content of the water-soluble organic solvent in the ink composition is preferably in a range of 60% by mass or less, and more preferably 20% by mass or less. When the content of the water-soluble organic solvent is 20% by mass or less, the occurrence of curling at the time of recording may be effectively prevented in spite of the change in humidity environment. The lower limit of the content of the water-soluble organic solvent is 1% by mass.

One kind of the water-soluble organic solvents may be used alone, or two or more kinds of them may be used in mixture.

Further, the content ratio of the water-soluble organic solvent having an SP value of 27.5 or less (particularly, the compound represented by Structural formula (1)) relative to the total mass of the water-soluble organic solvents is preferably 10% by mass or higher, more preferably 30% by mass or higher, and even more preferably 50% by mass or higher. When the content of the water-soluble organic solvent having an SP value of 27.5 or less is within the above range, the occurrence of curling can be more effectively suppressed without causing deterioration in stability or ejectability of ink.

Water

The ink composition in the present invention may include water. There is no particular limitation concerning the amount of water. Above all, from the viewpoint of ensuring stability and ejection reliability, the amount of water with respect to the total mass of the ink composition is preferably from 10% by mass to 99% by mass, more preferably from 30% by mass to 80% by mass, and even more preferably from 50% by mass to 70% by mass.

Surfactant

The ink composition in the present invention may include at least one surfactant. By the addition of a surfactant, the surface tension of the inkjet ink composition can be adjusted.

Examples of the surfactant include a nonionic surfactant, a cationic surfactant, an anionic surfactant, and a betaine surfactant. A nonionic surfactant is preferable. Specific examples of the nonionic surfactant include polyoxyethylene lauryl ether, polyoxyethylene octyl phenyl ether, polyoxyethylene oleyl phenyl ether, polyoxyethylene nonyl phenyl ether, oxyethylene-oxypropylene block copolymer, t-octylphenoxyethyl polyethoxyethanol, nonylphenoxyethyl polyethoxyethanol, and acetylene based polyoxyethylene oxide surfactants such as SURFYNOLS (trade name, manufactured by Air Products & Chemicals) and OLFINE E1010 (trade name, manufactured by Nissin Chemical Industry Co., Ltd.)). One or two or more of these surfactants may be selected. Acetylene based polyoxyethylene oxide surfactants are preferable.

The addition amount of the surfactant is preferably an amount that adjusts the surface tension of the ink composition to the following range, in order to be well ejected by an inkjet method.

The surface tension (at 25° C.) of the ink composition is preferably from 20 mN/m to 60 mN/m, more preferably from 20 mN/m to 45 mN/m, and even more preferably from 25 mN/m to 40 mN/m. The surface tension is measured using AUTOMATIC SURFACE TENSIOMETER CBVP-Z (trade name, manufactured by Kyowa Interface Science Co., Ltd.) under the condition of ink temperature of 25° C.

Specifically, the content of the surfactant in the ink composition is preferably 1% by mass or higher, more preferably from 1% by mass to 10% by mass, and even more preferably from 1% by mass to 3% by mass, with respect to the total mass of the ink composition.

Other Additives

In addition to the components described above, the ink composition in the invention may further include one or more other additives, as necessary. Examples of other additives in the invention include known additives such as an anti-fading agent, an emulsion stabilizer, a penetration enhancing agent, a UV absorber, an antiseptic agent, an antimildew agent, a pH adjuster, an antifoam agent, a surface-tension controller, a viscosity adjuster, a dispersant, a dispersion stabilizer, an antirust agent and a chelating agent. Specific examples of the additives include the additives that are described as other additives in paragraphs [0153] to [0162] of JP-A No. 2007-100071, which are incorporated herein by reference.

The viscosity of the ink composition of the invention is preferably from 4.5 mPa·s to 6.5 mPa·s, more preferably from 5 mPa·s to 6 mPa·s, from the viewpoints of ejection stability and coagulation speed in an inkjet method. When the application of the ink composition is performed by a method other than inkjet, the viscosity of the ink composition is preferably from 1 mPa·s to 40 mPa·s, and more preferably from 5 mPa·s to 20 mPa·s.

Here, the viscosity of the ink composition is a value obtained by a measurement using an E-type viscometer (manufactured by TOKI SANGYO CO., LTD.) at 25° C.

—Drying Process—

In the drying process, the treatment liquid and ink composition applied in the treatment liquid applying process and ink applying process are subjected to heating and drying.

Heating and drying can be carried out by a known heating means such as a heater, a blow means utilizing blown from a dryer or the like, or a means combining these. Examples of heating methods include a method of applying heat by a heater or the like from the surface of the recording medium opposite from the surface applied with the treatment liquid, a method of blowing a warm air or hot air to the surface of the recording medium applied with the treatment liquid, and a method of heating using an infrared heater. Heating can also be performed by using two or more of these methods in combination.

The temperature at the time of heating and drying is not particularly limited, and a temperature region which enables drying may be selected. For example, heating may be performed by blowing so that the temperature of the recording medium reaches a temperature of from 45° C. to 70° C. Alternatively, drying may be performed by contacting the recording medium with a drying drum heated at a temperature of from 45° C. to 70° C. so that the temperature of the recording medium reaches a temperature of from 45° C. to 70° C. Alternatively, drying may be performed by using these methods in combination.

—Cooling Process—

In the cooling process, the recording medium that has been subjected to drying is cooled to a temperature of 35° C. or lower. The recording medium is heated and dried at the above drying process, and then, before accumulation, the recording medium is cooled.

The temperature of recording medium is a value [° C.] measured as a temperature of the recording medium when the recording medium is accumulated (immediately after accumulation), which has being subjected to cooling processing after drying. By cooling the recording medium to the temperature of 35° C. in the accumulation stage, stacker blocking can be suppressed when the recording medium is in an accumulated state. The temperature of the recording medium may be measured using a temperature and humidity meter for measuring paper stacks and rolls (trade name: HYGROPALM, manufactured by Rotronic), which is disposed between desired recording media at the time of accumulation (immediately after accumulation).

The temperature after cooling may be 35° C. or lower. However, from the viewpoint of prevention of stacker blocking, the temperature after cooling is preferably 30° C. or lower. The lower limit of the temperature after cooling is not particularly limited.

The cooling method may be any method as long as it is a cooling process that can positively lower the temperature of the recording medium. Examples of the cooling method include a method of passing the recording medium though a cooling zone, a method of blowing a cold air to the recording medium, and a method of contacting the recording medium with a cooled substance.

—Accumulation Process—

In the accumulation process, the recording medium which has been cooled in the cooling process is accumulated to the accumulation unit. The recording medium being temporarily heated at the time of drying, then, cooled, and then accumulated, the occurrence of stacker blocking between the recording media due to accumulation may be prevented.

The expression "accumulation of recording medium" means to retrieve the recording medium in the form of sheets through stacking in a bundle at an arbitrary accumulation unit. Accumulation is carried out by means of, for example, free fall into an area corresponding to the plane size of the recording medium or the like. In the present invention, stacker blocking can be prevented, which may easily occur in the case in which 50 sheets or more of the recording medium are stacked as described above.

In the accumulation process, it is preferable to blow in the accumulation unit, where the recording media are accumulated, at least from the direction which intersects the accumulation direction of the recording media, and to supply gas between the recording media accumulated in the accumulation unit (hereinafter, may be also referred to as "seasoning"). Blowing may be conducted from the direction which intersects the accumulation direction, but it is preferable that gas is supplied from the direction parallel to the direction from one end of the recording medium to the medium surface so that the gas spreads between the recording media. When plural sheets of a recording medium which have been accumulated in the accumulation unit are maintained being adhered and stacked, in a case in which image formation is performed at a high speed or on both sides of a recording medium, a quantity of solvents remain in the image, and as a result, image transfer, sticking, or the like may occur between the recording media adjacent to each other, and therefore, the image may be destructed when the sheets are separated or defects such that the backside of the medium is stained or the like (stacker blocking) may occur easily. On the other hand, in the present invention, gas such as air is blown between the recording media by blowing, whereby the solvent components in the image vaporize and the soft image units become strong to be able to effectively prevent the occurrence of stacker blocking due to accumulation.

Blowing may be carried out by using a blow means which is disposed so that it is possible to blow in the direction which intersects the accumulation direction of the recording media. Specifically, a blow means which has an opening for blowing (a blow port) (for example, a rotating fan equipped with rotating blades at the air discharge port) can be employed. When blowing from the blow means starts, the recording medium floats by the power of blown air, and a space is formed between the media.

In a preferable embodiment, blowing may be carried out with respect to a bundle of the recording media accumulated in the accumulation unit from at least one face of the bundle, to supply gas between the recording media that form the bundle at a time. In this case, it is preferable that the blow means has (an) blow port(s) that cover(s) almost the entire region of the medium storage range, which is regulated by a top board unit and a stacking tray on which recording media are to be placed and stacked.

From the viewpoint of enhancing the effect on preventing stacker blocking, blowing may be carried out with respect to plural faces of the bundle of the recording media accumulated in the accumulation unit, from plural directions that respectively face the plural faces of the bundle of recording media accumulated in the accumulation unit.

The quantity of blown gas that passes through, per one sheet of the recording medium and per unit length in the width direction of the medium when seen from a side from which the supplied gas is supplied, is preferably 0.02 $m^3 \cdot min^{-1} \cdot m^{-1}$ or more. By adjusting the blown gas quantity to be within this range, and by applying gas (for example, air) to a recording medium bundle from at least one side of the bundle under the blow condition of 0.02 $m^3 \cdot min^{-1} \cdot m^{-1}$ or more, a necessary amount of blown gas can be applied between the recording media. Thereby, seasoning of a bundle of printed matters can be carried out at a time, in a short time and uniformly, and as a result, the effect on preventing stacker blocking can be further enhanced. The blown gas quantity is more preferably in a range of from 0.02 $m^3 \cdot min^{-1} \cdot m^{-1}$ to 0.5 $m^3 \cdot min^{-1} \cdot m^{-1}$. When the quantity is 0.5 $m^3 \cdot min^{-1} \cdot m^{-1}$ or less, good accumulation properties may be maintained.

The blowing is preferably carried out by supplying air in the temperature and humidity environment of the surroundings of the accumulation unit as it is. An embodiment in which the circumferential air is blown, as it is, is preferable, from the viewpoint of letting the recording medium after image formation adapt to the humidity of the circumferential environment promptly and uniformly. Further, the above embodiment may be formed with low costs, utilizing a rotary fan having simple rotary blades.

The static pressure of the air blown from the blow means is preferably 500 [Pa] or higher. Assuming that the recording medium has a medium size widely used in general (for example, half Kiku size 636 mm×469 mm), it is preferable that the static pressure is 500 [Pa] or higher.

The case which simultaneously satisfy the two conditions of the blown gas quantity q of air that passes through, per one sheet of the recording medium and per unit length in the width direction of a recording medium when seen from the blowing side of the blow means, being $q>0.02\ m^3 \cdot min^{-1} \cdot m^{-1}$ and the static pressure P of the air blown from the blow means being P>500 Pa is more preferable.

Here, an example of the configuration of a seasoning device that performs blowing is explained. FIG. 1 is a perspective view of a seasoning device.

As shown in FIG. 1, a seasoning device 50 is equipped with a stacking tray 52, on which plural sheets of a recording medium (not shown in FIG. 1) can be placed and stacked, and blowers 54 that blow toward the outer circumferential side of a medium bundle which is placed on the stacking tray 52. In FIG. 1, axial-flow blowers are drawn. However, the blow system is not particularly limited thereto, and centrifugal blowers may be also employed.

The seasoning device 50 has a configuration such that blowing is carried out from one side corresponding to a longer side of a square medium, and plural blowers 54 are disposed along the at the blow side (six blowers 54 are illustrated in FIG. 1). A cover 57 in which a blow port 56 is formed (blow nozzle) is mounted at the air discharge port side in each of the blowers 54. The blow port 56 is formed so as to have an opening length almost the same as the height of the medium storage range in the accumulation direction of media, so that blow can be discharged at a time with respect to almost the entire region of the height of a medium storage range defined by the stacking tray 52 and a top board (which is not shown in FIG. 1, but is described in FIG. 2 as symbol 76). By having such a configuration, blow can be almost uniformly applied to all of the recording media placed on the stacking tray 52 at a time. It should be noted that the number and specification of the blowers 54 included in the blow means, the size and form of the blow port 56, and the like are design so as to obtain a blow amount and pressure necessary for satisfying the above blow conditions.

Among the four outer circumferential faces of the stacking tray 52, the face at which a row of the blowers 54 are disposed is provided with a side board 60. In the side board 60, openings or slits (hereinafter, referred to as discharge ports 62), which correspond to the blow ports 56 of the blowers 54, are provided. As described above, by having a configuration such that the range of the air discharge port 62 is restricted and the circumference of the blow port 56 of the blower 54 is covered with a wall member (side board 60), the progressing direction of the air blown out from each of the blowers 54 is regulated to prevent leakage of the blown air. Therefore, the blow generated by the blower 54 can be efficiently introduced to a medium storage space 58 on the stacking tray 52, and a strong blow can be applied to the medium bundle placed on the stacking tray 52.

In the outer circumference of the stacking tray 52, side boards 64 and 65 are provided at the two sides on both right and left sides of the side in which the row of the blowers 54 is disposed. The side boards 64 and 65 cover the side faces of the two sides corresponding to the shorter sides of the recording medium to be placed on the stacking tray 52, and prevent leakage of air from the side faces, and further, control flapping of media.

Further, a ventilating hole 66 is provided at the longer side facing the side board 60 that is provided with the row of blowers 54. The size of the ventilating hole 66 can be appropriately designed; however, it is desirable to ensure a sectional area as wide as possible in order not to prevent the flow of air blown from the blowers 54.

Figure 2:
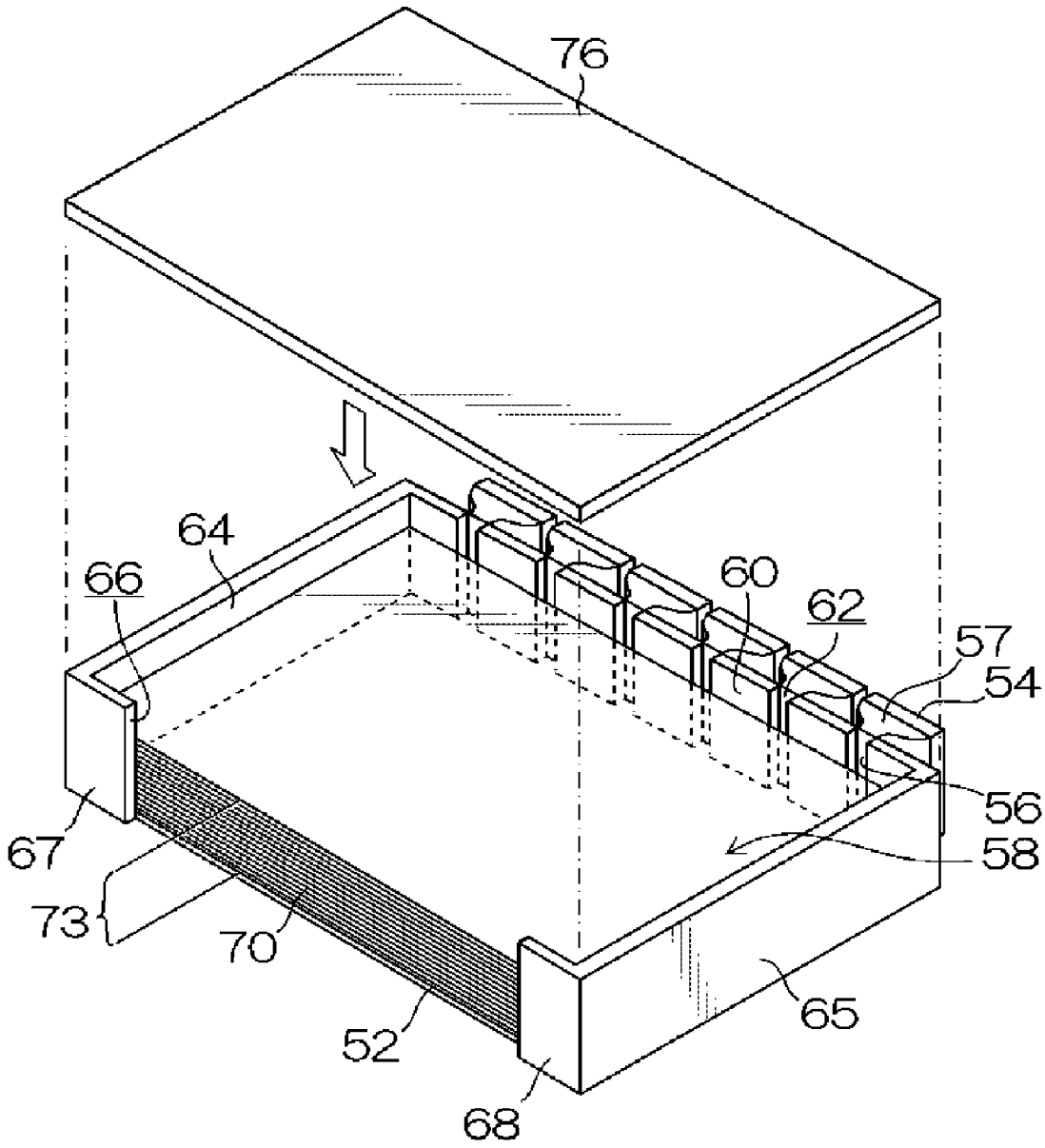
FIG. 2 is a perspective view showing the state in which sheets of a recording medium are placed on the seasoning device of FIG. 1.

FIG. 2 is a perspective view showing the state in which a bundle 73 of recording media 70 is placed on the stacking tray 52, which is drawn when seen from a side of the ventilating hole 66.

As shown in FIG. 2, a bundle 73 of recording media 70 after printing is placed on the stacking tray 52, and the stacking tray is covered with a top board 76. The top board 76 plays a part to prevent whirling up of the recording media 70 during blowing. The top board 76 may be configured so as to be fixed at a position of a predetermined height, such that the top board contacts with the top end face of the side boards 60, 64, 65, 67, and 68 to cover the top face of the medium storage space 58, or may be configured so as to be able to appropriately adjust the position of a height of the top board 76 in accordance with the number of sheets of the recording medium 70.

Figure 3:
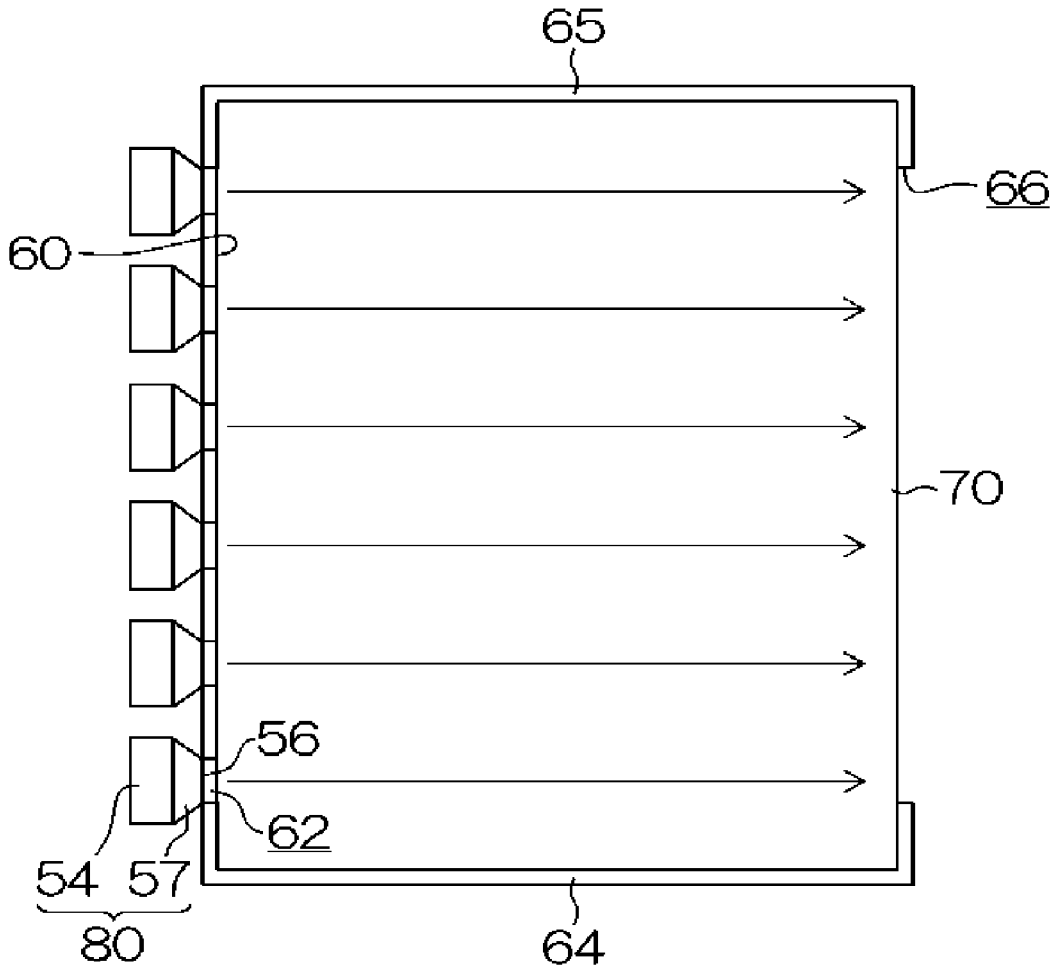
FIG. 3 is a plane view schematically showing the state at the time of blowing.
Figure 4:
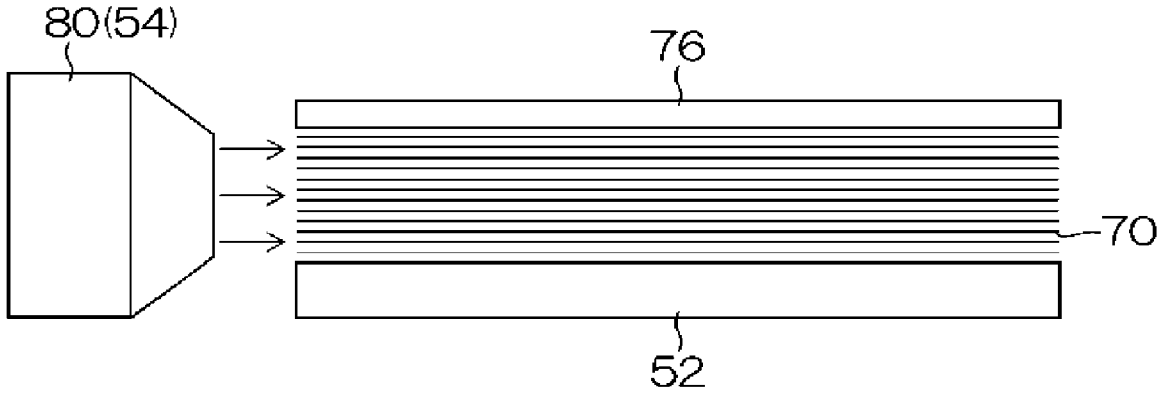
FIG. 4 is a side view schematically showing the state at the time of blowing.

FIG. 3 is a plane view schematically showing the state at the time of blowing, and FIG. 4 is a side view thereof.

In these figures, symbol 80 represents a blow unit, which corresponds to the blowers explained in FIG. 1 and FIG. 2 as symbol 54. As shown in FIG. 3 and FIG. 4, air is blown from one side of a recording medium 70 by the blow unit 80, whereby air is blown to a face of the medium bundle 73. In the seasoning device 50 in this exemplary embodiment, whose main purpose is to attain a uniform amount of moisture in the inside of the recording medium 70 after printing, from the viewpoint of prevention of excessive drying, it is preferred that the blow unit 80 blows out the circumferential air (blows out air having a temperature and humidity of circumferential environment). Suppose that a means of blowing low-humidity air, for example, air that is heated using a heater or the like (hot air), compressed air, dry air, or the like, is employed, the amount of remaining moisture is below the environmental saturation point, and shrinkage of paper may occur.

For instance, if a low humidity air is employed, drying in a short time becomes possible at a region, to which a large amount of ink is applied, in the recording medium 70, while an excessive drying state is exhibited at a non-ink-applied unit or at a region including extremely small amount of ink in the recording medium 70. Due to such a difference in moisture amount, there is a possibility to occur expansion or shrinkage (transformation) of the recording medium, and therefore, it is not preferable to employ a means of blowing hot air of a temperature and humidity different from environmental temperature and humidity, compressed air, or the like.

The blow unit 80 in this exemplary embodiment is configured so as to send air (blow air) having a temperature and humidity of circumferential environment by the use of blowers 54 (see, FIG. 1), and a means for controlling or adjusting the temperature and humidity, for example, a heating means such as a heater or a dehumidification means, is not provided.

As described above, by sending the air of circumferential environment and blowing the air of circumferential environment between the media by the blow unit 80, moistened portions in the recording medium are dried, while dried portions get wet, whereby the moisture amount inside the medium can be adjusted to be uniform (and to get close to the environmental temperature and humidity).

Hereinafter, an example of the configuration of an inkjet recording apparatus to execute the image forming method of the present invention is explained with reference to FIG. 5.

An inkjet recording apparatus 1 is an inkjet recording apparatus of an impression cylinder-direct imaging system which forms desired color images through spotting inks of plural colors from inkjet heads 172M, 172K, 172C, and 172Y onto a recording medium 122 that is held by an impression cylinder (imaging drum 170) in an imaging unit 114. Further, the inkjet recording apparatus 1 is an on-demand type image forming apparatus applying a two-liquid reaction (aggregation) system, in which a treatment liquid is applied onto the recording medium 122 before spotting ink, and then the treatment liquid and the ink are allowed to react to form an image on the recording medium 122.

The inkjet recording apparatus 1 is configured to mainly include a paper supply unit 110, a treatment liquid applying unit 112, an imaging unit 114, a drying unit 116, a fixing unit 118, and a paper discharge unit 120. The seasoning device 50 explained in FIG. 1 to FIG. 4 is provided at the portion of a discharge tray 192 in the paper discharging unit 120.

The paper supply unit 110 has a mechanism of supplying the recording medium 122 to the treatment liquid applying unit 112, and in the paper supply unit 110, sheets of the recording medium 122 are stacked. The paper supply unit 110 is provided with a paper supply tray 150, and from this paper supply tray 150, the recording medium 122 is supplied to the treatment liquid applying unit 112 one by one. In the inkjet recording apparatus 1, as the recording medium 122, plural kinds of recording media 122 which are different in the kind of paper or size (medium size) can be used. In this exemplary embodiment, a case of using a sheet (cut paper) as the recording medium 122 is explained; however, a configuration of supplying paper through cutting a continuous medium (roll paper) in a needed size can be also employed.

The treatment liquid applying unit 112 has a mechanism of applying the treatment liquid to the recording surface of the recording medium 122. The treatment liquid contains a colorant aggregating agent that aggregates a colorant (in this exemplary embodiment, a pigment) in the ink that is applied at the imaging unit 114. When the treatment liquid contacts with the ink, separation of the colorant and solvent in the ink is accelerated.

Figure 5:
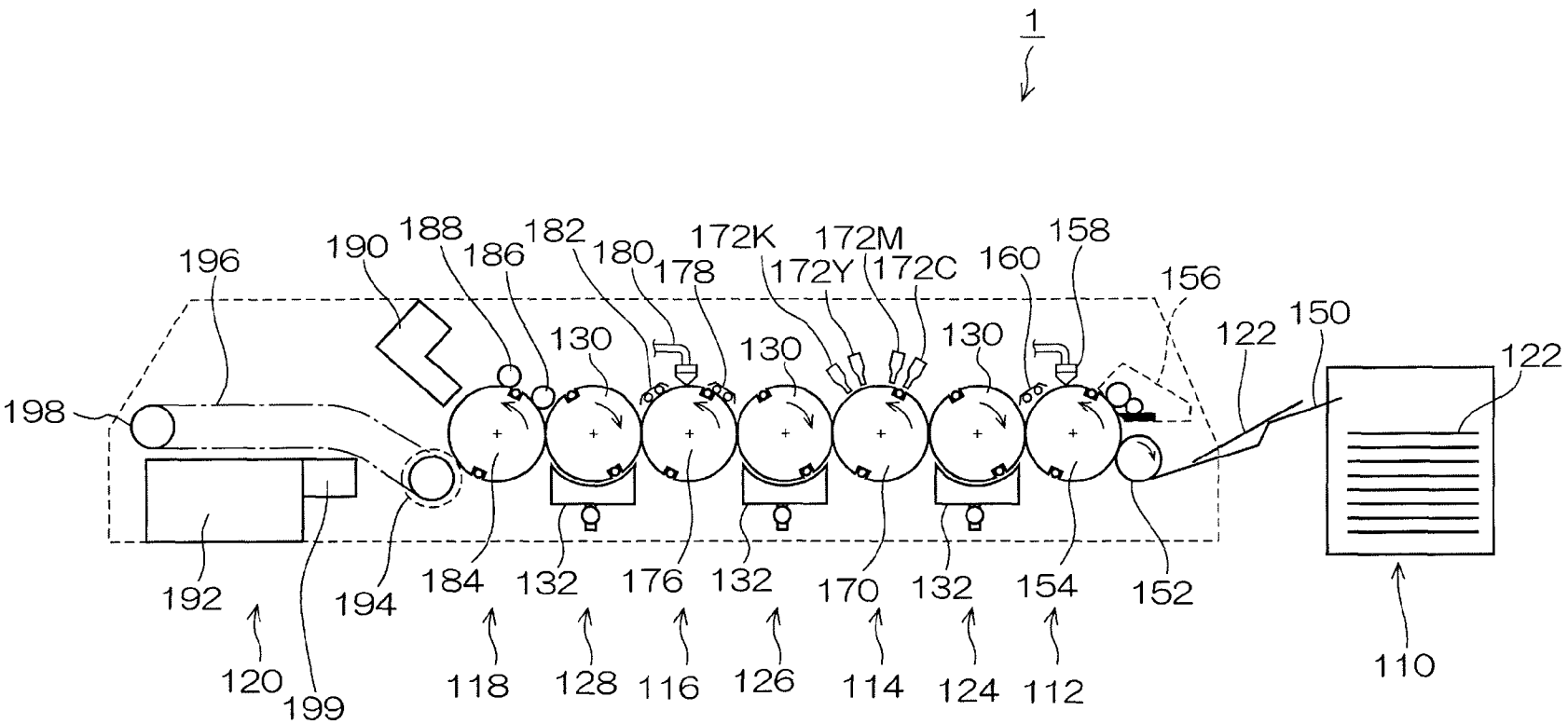
FIG. 5 is a cross sectional view schematically showing an example of the configuration of an inkjet recording apparatus.

As shown in FIG. 5, the treatment liquid applying unit 112 is equipped with a paper supply drum 152, a treatment liquid drum 154, and a treatment liquid coating device 156. The treatment liquid drum 154 holds the recording medium 122, and is a drum that rotates and conveys the recording medium. The treatment liquid drum 154 is equipped with a holding means (gripper) in the form of a claw at the outer circumferential surface thereof, and by putting the recording medium 122 between the claw of the holding means and the circumferential face of the treatment liquid drum 154, the front end of the recording medium 122 can be held. The treatment liquid drum 154 may be provided with suction holes at the outer circumferential surface thereof, and a suction means that performs suction through the suction holes may be connected to the treatment liquid drum. Accordingly, the recording medium 122 can be adhered and held on the circumferential surface of the treatment liquid drum 154.

On the outer side of the treatment liquid drum 154, a treatment liquid coating device 156 is arranged so as to face the circumferential surface of the treatment liquid drum. The treatment liquid coating device 156 includes a treatment liquid container to stock the treatment liquid, an Anilox roller in which a part thereof is immersed in the treatment liquid in the treatment liquid container, and a rubber roller that transfers the treatment liquid after measurement onto the recording medium 122, through being pressed against the Anilox roller and the recording medium 122 on the treatment liquid drum 154. This treatment liquid coating device 156 makes it possible to apply the treatment liquid while measuring onto the recording medium 122.

In this exemplary embodiment, a configuration applying a coating system using a roller is described, but the present invention is not limited thereto. Various systems, for example, a spray system, an inkjet system, or the like can be applied. From the viewpoint of suppressing increase in the application amount of the treatment liquid, an inkjet system is preferable.

The recording medium 122 to which the treatment liquid has been applied at the treatment liquid applying unit 112 is delivered from the treatment liquid drum 154 via an intermediate transporting unit 124 to an imaging drum 170 in the imaging unit 114. The imaging unit 114 is equipped with the imaging drum 170 and the inkjet heads 172M, 172K, 172C, and 172Y. Similar to the treatment liquid drum 154, the imaging drum 170 is equipped with a holding means (gripper) in the form of a claw at the outer circumferential surface thereof. The recording medium 122 that is fixed to the imaging drum 170 is conveyed such that the recording surface faces the outer side and, onto this recording surface, inks are each ejected from the inkjet heads 172M, 172K, 172C, and 172Y.

The inkjet heads 172M, 172K, 172C, and 172Y are each a recording head (inkjet head) of a full line type inkjet system having a length corresponding to the maximum width of the region for image formation in the recording medium 122. At the ink discharge face of the inkjet heads, a row of nozzles is formed, in which plural nozzles for ink discharge are arranged over the entire width of the region for image formation. The inkjet heads 172M, 172K, 172C, and 172Y are each disposed so as to be positioned in a direction perpendicular to the conveyance direction of the recording medium 122 (rotation direction of the imaging drum 170).

From each of the inkjet heads 172M, 172K, 172C, and 172Y, liquid droplets of a corresponding color ink are discharged toward the recording surface of the recording medium 122 which is adhered and held on the imaging drum 170. Thereby, the ink is brought into contact with the treatment liquid that has been applied to the recording surface in advance at the treatment liquid applying unit 112, and thus, the pigment and the resin particles, which have been dispersed in the ink, aggregate to form aggregates. In this manner, flowing of pigment on the recording medium 122 and the like are prevented, and an image is formed on the recording surface of the recording medium 122.

The recording medium 122, on which an image has been formed at the imaging unit 114, is delivered from the imaging drum 170 via an intermediate transporting unit 126 to a drying drum 176 in the drying unit 116. The drying unit 116 has a mechanism of drying moisture contained in the solvent which is separated by an action of aggregation. As shown in FIG. 5, the drying unit is equipped with the drying drum 176, IR (infrared) heaters 178 and 182, and a hot air discharge nozzle 180 disposed between the IR heaters. Similar to the treatment liquid drum 154, the drying drum 176 is equipped with a holding means (gripper) in the form of a claw at the outer circumferential surface thereof so that the front end of the recording medium 122 can be held by this holding means. Various drying conditions can be realized by appropriately adjusting the temperature and the amount of air of hot blown from the hot air discharge nozzle 180 toward the recording medium 122, and the temperature of each of the IR heaters.

Further, the surface temperature of the drying drum 176 is set to 50° C. or higher. The recording medium 122 is heated from the backside, whereby drying is accelerated, and image destruction which may be caused at the time of fixation can be prevented. It should be noted that the upper limit of the surface temperature of the drying drum 176 is not particularly limited, but from the viewpoint of safety (prevention of skin burn due to high temperature) in maintenance work such as cleaning of ink adhered to the surface of the drying drum 176, it is preferable to set the surface temperature to 75° C. or lower (more preferably, 60° C. or lower).

The recording medium being held on the outer circumferential surface of the drying drum 176 in such a manner that the recording surface of the recording medium 122 faces the outer side (namely, in a curved state in which the recording surface of the recording medium 122 is at a convex side) and being dried while being rotated and conveyed, the occurrence of wrinkle or floating of the recording medium 122 can be prevented and drying unevenness caused by these problems can be certainly prevented.

The recording medium 122, which has been subjected to the drying treatment at the drying unit 116, is delivered from the drying drum 176 via an intermediate transporting unit 128 to a fixing drum 184 in the fixing unit 118. The fixing unit 118 includes a fixing drum 184, a first fixing roller 186, a second fixing roller 188, and an inline sensor 190.

The fixing drum 184 is equipped with a holding means (gripper) in the form of a claw at the outer circumferential surface thereof, similar to the treatment liquid drum 154, so that the front end of the recording medium 122 can be held by this holding means. When the fixing drum 184 rotates, the recording medium 122 is conveyed in such a manner that the recording surface faces the outer side. With regard to this recording surface, fixing processing by using a first fixing roller 186 and a second fixing roller 188, and detection by using an inline sensor 190 are performed. The first fixing roller 186 and the second fixing roller 188 are each a roller member for applying heat and pressure to the ink in order to fuse the resin particles (particularly, self-dispersing polymer particles) in the ink and to make a film of ink, and are constituted so as to apply heat and pressure to the recording medium 122. Specifically, the first fixing roller 186 and the second fixing roller 188 are disposed so as to press against the fixing drum 184, and are configured so as to form nip rollers with the fixing drum 184. Thereby, the recording medium 122 is put between the first fixing roller 186 and the fixing drum 184, and thereafter, between the second fixing roller 188 and the fixing drum 184, and is nipped at a predetermined nip pressure (for example, 0.15 MPa). In this way, fixing processing is performed. Further, the first fixing roller 186 and the second fixing roller 188 are each constituted by a heating roller which is prepared by disposing a halogen lamp into a pipe of a metal such as aluminum having a sufficient heat conductivity, wherein the temperature of each fixing roller is adjusted to a predetermined temperature (for example, from 60° C. to 80° C.). When the recording medium 122 is heated by these heating rollers, a heat energy higher than the Tg (glass transition temperature) of the resin particle contained in the ink is applied to melt the resin particle, whereby a forced fixation is carried out with respect to the concavities and convexities of the recording medium 122, and simultaneously, the unevenness of the image surface is allowed to be leveled, to obtain glossiness. The inline sensor 190 is a measuring means for measuring the check pattern, moisture content, surface temperature, glossiness, and the like, with regard to the images fixed to the recording media 122. CCD (Charge Coupled Device) line sensor or the like may be applied.

In the fixing unit 118, the resin particles in a thin image layer formed at the drying unit 116 is heated and pressed by the fixing roller 188 to be melt, and as a result, the resin particles in the thin image layer can be fixed on the recording medium 122. Further, the surface temperature of the fixing drum 184 is set to 50° C. or higher. The recording medium 122 which is held on the outer circumferential surface of the fixing drum 184 is heated from the backside, whereby drying is accelerated, and image destruction which may be caused at the time of fixation can be prevented, and simultaneously, image strength may be enhanced by the effect on elevating the temperature of images.

As shown in FIG. 5, a paper discharge unit 120 is provided on the downstream side of the fixing unit 118 in a conveyance direction of the recording medium. The paper discharge unit 120 is equipped with a discharge tray 192, and between the discharge tray 192 and the fixing drum 184 in the fixing unit 118, so as to be in contact with them, a bridge drum 194, a transfer belt 196, and a stretching roller 198 are provided. The recording medium 122 is conveyed to the transfer belt 196 by the use of the bridge drum 194, and discharged into the discharge tray 192. As the discharge tray 192, the seasoning device 50 explained in FIG. 1 to FIG. 4 is employed. The discharge tray 192 exerts both of the function as a stacking tray for placing the stacked recording media after image formation and the function as a seasoning device.

Further, a cold air discharge nozzle 199 is annexed to the discharge tray 192 so that cooling of the recording medium 122 can be carried out by blowing a cold air from the cold air discharge nozzle 199.

Moreover, although not shown in FIG. 5, in addition to the configuration described above, the inkjet recording apparatus 1 is equipped with ink storage tanks that supply inks to each of the inkjet heads 172M, 172K, 172C, and 172Y, and a means to supply the treatment liquid to the treatment liquid applying unit 112, as well as a head maintenance unit that performs cleaning (wiping the nozzle face, purge, nozzle suction, or the like) of each of the inkjet heads 172M, 172K, 172C, and 172Y, a position detection sensor to detect the position of recording medium 122 on the medium conveyance path, a temperature sensor to detect the temperature of each units in the apparatus.

Further, in the case of performing image formation on both sides of a recording medium, in the inkjet recording apparatus 1 of FIG. 5, after performing image formation on one side (front surface) of the recording medium, seasoning is carried out for a predetermined time by using the seasoning device 50. Then, a bundle of the recording media that have been subjected to seasoning processing is brought back to the paper supply unit 110, and then, image formation is further performed on the backside. In this manner, a good double-sided printing in a short time may be realized.

The inkjet recording apparatus 1 shown in FIG. 5 may be configured such that plural seasoning devices 50 used for discharge tray 192 are disposed, the seasoning devices 50 each being movable between the paper discharge unit 120 and the paper supply unit 110.

EXAMPLES

The present invention is further described below in detail with reference to the examples, but it should be construed that the invention is in no way limited to these examples as long as not departing from the scope of the present invention. Note that, "part" is based on mass, unless otherwise noted.

The weight average molecular weight was measured by gel permeation chromatography (GPC) and calculated based on polystyrene. For the GPC, HLC-8020GPC (trade name, manufactured by Tosoh Corporation) was used and, as columns, TSK GEL SUPER HZM-H, TSK GEL SUPER HZ4000, and TSK GEL SUPER HZ200 (all trade names, manufactured by Tosoh Corp.) were used. Further, THF (tetrahydrofuran) was used as an eluate.

Example 1

Preparation of Polymer Particles

—Preparation of Water Dispersion of Self-Dispersing Polymer Particles B-01—

560.0 g of methyl ethyl ketone was placed in a 2 L three-necked flask equipped with a stirrer, a thermometer, and a reflux cooling tube, and heated to a temperature of 87° C. While maintaining the gas inside the reaction vessel in a refluxed state (thereafter, refluxing was continued until the reaction was completed), to this reaction vessel, a mixture including 266.8 g of methyl methacrylate, 63.8 g of methoxyethyl acrylate, 203 g of benzyl methacrylate, 46.4 g of methacrylic acid, and 2.32 g of "V-601" (trade name, manufactured by Wako Pure Chemical Industries, Ltd.) was added dropwise at a constant speed so as to complete the addition in two hours. After completing the addition, the resulting mixture was stirred for one hour. Thereafter, a solution of 1.16 g of "V-601" and 6.4 g of methyl ethyl ketone was added thereto, and the mixture thus obtained was stirred for two hours (process (1)). Subsequently, this process (1) was repeated for four times. Then, a solution of 1.16 g of "V-601" and 6.4 g of methyl ethyl ketone was further added, and stirring was continued for 3 hours. After completion of the polymerization reaction, the temperature of the resulting solution was lowered to 65° C. and then, 163.0 g of isopropanol was added thereto and cooled while leaving it standing still. In this way, a resin solution of a copolymer (methyl methacrylate/methoxyethyl methacrylate/benzyl methacrylate/methacrylic acid=46/11/35/8) was obtained. The obtained copolymer had a weight average molecular weight (Mw) of 63,000 and an acid value of 65.1 mgKOH/g.

Next, the resin solution thus obtained was weighed by 317.3 g (solids concentration of 41.0% by mass), to which, then 46.4 g of isopropanol, 1.65 g of a 20% by mass aqueous solution of maleic anhydride (water-soluble acidic compound; as maleic acid, equivalent to 0.3% by mass with respect to the copolymer) and 40.77 g of a 2 mol/L aqueous solution of NaOH (sodium hydroxide) were added, and then the temperature inside the reaction vessel was elevated to 70° C. Subsequently, 380 g of distilled water was added dropwise at a rate of 10 mL/min, and the resulting mixture was subjected to water dispersion. Thereafter, the temperature inside the reaction vessel was kept at 70° C. under reduced pressure for 1.5 hours to distill off isopropanol, methyl ethyl ketone, and distilled water in a total distilled amount of 287.0 g. Then, 0.278 g of PROXEL GXL (S) (trade name, manufactured by Arch Chemicals Japan, Inc.) (as benzisothiazolin-3-one, 440 ppm with respect to the solid content of resin) was added to the resultant. Thereafter, filtration was performed using a filter having a pore size of 1 μm, and the filtrate was collected to obtain an aqueous dispersion of self-dispersing polymer particles B-01 having a solids concentration of 26.5%.

[Measurement of Glass Transition Temperature (Tg)]

The glass transition temperature of the self-dispersing polymer particles B-01 obtained as described above was measured according to the method described below, and the glass transition temperature of the self-dispersing polymer particles B-01 was revealed to be 90° C.

After polymerization, the resin solution was weighed by an amount that gives a solid matter amount of 0.5 g, which was then dried under a reduced pressure at 50° C. for 4 hours to obtain a solid matter of resin. Using the obtained solid matter of resin, the Tg was measured by a differential scanning calorimeter (DSC) EXSTAR6220 (trade name) manufactured by SII NanoTechnology Inc. The conditions for measurement were as follows. An aluminum pan containing a sample in an amount of 5 mg was sealed. The value at the top of peak for DSC of the data measured at a second temperature elevation on the following temperature profiles in a nitrogen atmosphere was defined as Tg.

30° C.→−50° C. (cooling at a rate of 50° C./min)

−50° C.→120° C. (temperature elevation at a rate of 20° C./min)

120° C.→−50° C. (cooling at a rate of 50° C./min)

−50° C.→120° C. (temperature elevation at a rate of 20° C./min)

—Preparation of Aqueous Dispersions of Self-Dispersing Polymer Particles B-02 to B-05—

Aqueous dispersions of the following self-dispersing polymer particles B-02 to B-05 were prepared in a manner substantially similar to that in the preparation of the aqueous dispersion of self-dispersing polymer particles B-01. In the self-dispersing polymer particles B-02, PME-100 represents BLEMMER PME-100 (trade name), manufactured by NOF Corporation.

B-02: methyl methacrylate/PME-100/isobornyl methacrylate/methacrylic acid copolymer (=44/20/26/10), Tg: 110° C.

B-03: methyl methacrylate/isobornyl methacrylate/methacrylic acid copolymer (=64/26/10), Tg: 140° C.

B-04: methyl methacrylate/isobornyl methacrylate/methacrylic acid copolymer (=38/52/10), Tg: 160° C.

B-05: methyl methacrylate/isobornyl methacrylate/methacrylic acid copolymer (=20/72/8), Tg: 180° C.

<Preparation of Pigment Dispersion Liquid>

—Synthesis of Resin Dispersant P-1—

88 g of methyl ethyl ketone was added in a 1000 mL three-necked flask equipped with a stirrer and a cooling tube, and heated to 72° C. under a nitrogen atmosphere. A solution prepared by dissolving 0.85 g of dimethyl-2,2'-azobisisobutyrate, 50 g of phenoxyethyl methacrylate, 11 g of methacrylic acid, and 39 g of methyl methacrylate in 50 g of methyl ethyl ketone was added thereto dropwise over 3 hours. After completion of the addition, the mixture was further allowed to react for one hour. Then, a solution prepared by dissolving 0.42 g of dimethyl-2,2'-azobisisobutyrate in 2 g of methyl ethyl ketone (MEK) was added thereto, and then the resulting mixture was heated for 4 hours, while elevating the temperature to 78° C. MEK was added to the obtained reaction solution. In this way, a 40% by mass MEK solution of phenoxyethyl methacrylate/methyl methacrylate/methacrylic acid (copolymerization ratio [mass ratio]=50/39/11) copolymer (resin dispersant P-1) was obtained.

The composition of the resin dispersant P-1 obtained as described above was confirmed by $^1$H-NMR, and the weight average molecular weight (Mw) determined by GPC was 49,400. Further, when the acid value of the copolymer was measured in accordance with the method described in JIS Standards (JIS K0070: 1992, which is incorporated herein by reference), the acid value of the copolymer was revealed to be 71.7 mgKOH/g.

—Preparation of Black Pigment Dispersion K—

100 g of carbon black (trade name: #2600, manufactured by Mitsubishi Chemical Corporation) as a pigment, the phenoxyethyl methacrylate/methyl methacrylate/methacrylic acid copolymer (resin dispersant P-1) in an amount on the basis of solid matter of 57 g, 155.8 g of methyl ethyl ketone, 80.8 g of a 1 mol/L aqueous solution of sodium hydroxide (neutralization degree with respect to methacrylic acid being 110 mol %) as a pH adjuster, and 491 g of ion exchanged water were pre-dispersed using a Disper, and then further dispersed using a bead mill disperser employing 0.1 mmϕ zirconia beads. After dispersion, the resulting dispersion was filtered using a filter having a pore size of 1 μm, and the filtrate was collected. Thereafter, the pigment concentration of the dispersion was determined by absorbance spectrum. In this way, a dispersion of resin-coated pigment particles having a pigment concentration of 15% (black pigment dispersion K) was obtained.

<Preparation of Ink>

Using the black pigment dispersion K obtained as described above and either one of the aqueous dispersions of self-dispersing polymer particles B-01 to B-05, the components described below were mixed to prepare the ink composition described below. The prepared ink composition was packed into a plastic disposable cylinder and filtered using a PVDF (polyvinylidene difluoride) 5 μm filter (trade name: MILLEX-SV, 25 mm in diameter, manufactured by Millpore Corporation). In this way, black inks (ink compositions) K-01 to K-05 were prepared.

<Composition>

| | |
|---|---|
| Carbon black | 4.0% by mass |
| Resin dispersant P-1 described above | 2.3% by mass |
| Aqueous dispersion of self-dispersing polymer particles shown in Table 1 below (based on solid matter) | 6.0% by mass |
| SANNIX GP250 (trade name, manufactured by Sanyo Chemical Industries, Ltd.; water-soluble organic solvent) | 6.0% by mass |
| Tripropylene glycol monomethyl ether (TPGmME) (manufactured by Wako Pure Chemical Industries, Ltd., water-soluble organic solvent) | 10% by mass |
| Urea (manufactured by Wako Pure Chemical Industries, Ltd., solid wetting agent) | 5.0% by mass |
| NEWPOL PE-108 (trade name, manufactured by Sanyo Chemical Industries, Ltd.; thickener) | 0.25% by mass |
| OLFINE E1010 (trade name, manufactured by Nissin Chemical Industry Co., Ltd.; surfactant) | 1.2% by mass |
| Ion exchanged water | an amount to give 100% by mass in total |

<Preparation of Treatment Liquid>

The components of the following composition were mixed to prepare a treatment liquid. The pH of the treatment liquid was 1.0.

<Composition of Treatment Liquid>

| | |
|---|---|
| Malonic acid (manufactured by Tokyo Chemical Industry Co., Ltd.) | 11% by mass |
| DL-malic acid (manufactured by Tokyo Chemical Industry Co., Ltd.) | 15% by mass |
| Diethylene glycol monobutyl ether (manufactured by Wako Pure Chemical Industries, Ltd.) | 4% by mass |
| Tripropylene glycol monomethyl ether (manufactured by Wako Pure Chemical Industries, Ltd.) | 4% by mass |
| Ion exchanged water | 66% by mass |

<Image Formation and Evaluation>

—Image Formation—

An inkjet recording apparatus shown in FIG. 5 was prepared, and sheets of TOKUBISHI ART DOUBLE-SIDED N (trade name, manufactured by Mitsubishi Paper Mills, Ltd.; area: 2,982 $cm^2$ (half Kiku size 636 mm×469 mm), basis weight: 104.7 $g/m^2$) as the recording medium were placed in a paper supply unit 110 in the inkjet recording apparatus, and further, the black inks K-01 to K-05 were placed in turn in an ink storage tank (not shown) which was connected to an ejection head 172K for black ink. Further, the above treatment liquid was placed in a treatment liquid tank (not shown) so that coating of the treatment liquid could be performed by using a treatment liquid coating device 156.

The treatment liquid was coated onto the entire surface of the recording medium 122 (TOKUBISHI ART DOUBLE-SIDED N (trade name)) which was sent from the paper supply unit 110 of the apparatus, wherein the coating was performed on a treatment liquid drum 154 (450 mm in diameter) by using the treatment liquid coating device 156 to give a thin film (1.4 μm in thickness). In this process, a gravure roller was used for the treatment liquid coating device 156. Subsequently, the recording medium 122 that had been coated with the treatment liquid was subjected to drying processing by using a hot air discharge nozzle 158 (spraying 70° C. air at 9 $m^3$/min) and an IR heater 160 (180° C.), whereby a part of the solvents in the treatment liquid was dried.

The resulting recording medium 122 was conveyed to an imaging unit 114 via a first intermediate transporting unit 124, and according to image signals, the black ink was ejected from the ejection head 172K to draw images. In this process, the ejection volume of the ink was set to 1.4 pL at highlight areas and 3 pL at high-density areas (2 drops), and the recording density was adjusted to be recorded at 1,200 dpi for both of the main scanning direction and the sub-scanning direction.

Here, in a case in which non-ejection nozzle occurred, a treatment for making it difficult to see the streaked unevenness due to non-ejection was performed by using a nozzle adjacent to the non-ejection nozzle employing an ejection volume of 5 pL (3 drops). Further, the treatment liquid drum 154 and a drying drum 176 were disposed independently from an imaging drum 170, and therefore, even in the case of performing drying of the treatment liquid at a high speed, the imaging unit was free from an adverse influence of heat or air for drying, and stable ejection was to be attained.

Next, the recording medium 122 on which an image had been formed was conveyed to a drying unit 116 via a second intermediate transporting unit 126, and was dried on the drying drum 176 by using a first IR heater 178 (surface temperature: 180° C.), a hot air discharge nozzle 180 (70° C. hot air×air quantity of 12 $m^3$/min), and a second IR heater 182 (surface temperature: 180° C.). The time for drying was about two seconds. After drying, the recording medium 122 was conveyed to a fixing unit 118 via a third intermediate transporting unit 128. In the fixing unit 118, the recording medium 122 on which an image had been formed was heated and fixed at a nip pressure of 0.30 MPa by using a 50° C. fixing drum 184, an 80° C. first fixing roller 186, and a second fixing roller 188. In this process, as the first fixing roller 186 and the second fixing roller 188, rollers were used, which were each prepared by disposing silicone rubber having a hardness of 30° at a thickness of 6 mm on the surface of a cylindrical core metal made of metal, and then subjecting this to soft PFA (fluororesin) coating (50 μm in thickness), and exhibit excellent adhesion and excellent peeling properties with respect to ink images.

Subsequent to the heating and fixing, the recording medium 122 was cooled such that the surface thereof was cooled to a temperature shown in Table 1, by blowing cold air of 18° C. to 20° C. from a cold air discharge nozzle 199 to the recording medium. The surface temperature was measured by a method described below. Thereafter, by using a bridge drum 194, a transfer belt 196, and a stretching roller 198, which were provided between a discharge tray 192 in a paper discharge unit 120 and the fixing drum 184 in the fixing unit 118, the recording medium 122 was conveyed to the transfer belt 196 by the use of the bridge drum 194, discharged into a discharge tray 192, and accumulated.

Further, the discharge tray 192 used for accumulation of the recording medium 122 was equipped with the seasoning device 50 explained in FIG. 1 to FIG. 4. Thereby, air could be blown (seasoning) between the recording media through blowing air of the circumferential atmosphere toward one face of a bundle of the accumulated recording media. In this process, the quantity of air which passed through, per one sheet of the recording medium and per unit length in the width direction of the medium when seen from the supply side of the air to be supplied, was set to 0.05 $m^3 \cdot min^{-1} \cdot m^{-1}$. As described above, the discharge tray 192 has a configuration such that it exerts both of the function as a stacking tray for placing the stacked recording media after image formation and the function as a seasoning device.

In the above, the conveyance of the recording medium 122 was actuated at a conveyance speed of 535 mm/s by drum conveyance using drums 154, 170, 176, and 184.

Through performing the above processes, a one-sided successive printing on 2,000 sheets was carried out. After leaving the printed samples under an environment of 25° C. and 60% RH for one hour as they were, printing was further carried out on the backside of the printed surface in a manner substantially similar to the above, whereby double-sided printing was carried out. In this process, a temperature and humidity meter for measuring paper stacks and rolls (trade name: HYGROPALM, manufactured by Rotronic) was placed between the 400th sheet and the 401st sheet of the printed recording media at the time of double-sided printing, and the temperature of the paper sheet (recording medium) immediately after accumulation after subjected to heating and drying was measured. Measurement results are shown in Table 1 below.

—Evaluation of Stacker Blocking—

2,000 sheets of the recording medium which were accumulated and stacked on the discharge tray were stored under an environment of 25° C. and 60% RH for 24 hours, and whether stacker blocking between the 500th sheet and the 501st sheet of the image-formed recording medium occurred or not was evaluated according to the following criteria.

<Evaluation Criteria>

A: sticking is not felt when peeling the paper surfaces, and adherence of paper is not visually observed.

B: a sticking sound is produced when peeling the paper surfaces, but adherence of paper cannot be visually confirmed.

C: there is an adhesive portion in an extremely small part of the printed surface (about one portion in an area of 10 $cm^2$), and adherence of paper can be visually recognized.

D: adhesion occurs over the whole printed surface, and adherence of paper can be recognized over the whole region.

TABLE 1

| | | Resin Particle | | Cooling | | Seasoning | Evaluation | |
|---|---|---|---|---|---|---|---|---|
| No. | Ink No. | No. | Tg (° C.) | (whether done or not) | Paper Surface Temperature (° C.) | (whether done or not) | of Stacker Blocking | Note |
| 1 | K-01 | B-01 | 90 | not done | 40 | not done | D | Comparative |
| 2 | K-02 | B-02 | 110 | not done | 40 | not done | C | Comparative |
| 3 | K-01 | B-01 | 90 | done | 35 | not done | D | Comparative |
| 4 | K-02 | B-02 | 110 | done | 35 | not done | B | Invention |
| 5 | K-03 | B-03 | 140 | done | 35 | not done | B | Invention |
| 6 | K-04 | B-04 | 160 | done | 35 | not done | A | Invention |
| 7 | K-05 | B-05 | 180 | done | 35 | not done | A | Invention |
| 8 | K-03 | B-03 | 140 | done | 35 | done | B | Invention |
| 9 | K-04 | B-04 | 160 | done | 35 | done | A | Invention |
| 10 | K-05 | B-05 | 180 | done | 35 | done | A | Invention |

In Table 1 above, regarding No. 8 to No. 10, after the recording medium had accumulated on the discharge tray, seasoning was carried out by blowing for 30 minutes, and then the 2,000 sheets of the recording medium in a stacked form were stored under an environment of 25° C. and 60% RH for 24 hours. Thereafter, stacker blocking between the 500th sheet and the 501st sheet of the printed recording medium was evaluated.

As shown in Table 1 above, in the example of the present invention, the occurrence of stacker blocking was prevented, and a high grade image was obtained. On the other hand, in the comparative examples, stacker blocking occurred and a high grade printed matter excellent in image quality was not obtained.

Example 2

Image formation and evaluation were performed in a manner substantially similar to that in Example 1, except that the treatment liquid stored in the treatment liquid tank was filled into an ink storage tank (not shown) which was connected to the ejection head 172C for cyan ink, and the treatment liquid was ejected so as to be applied onto the image region of the recording medium 122 on which the black ink was to be applied, at an ejection volume of 3 pL and at a recording density of 1,200 dpi for both of the main scanning direction and the sub-scanning direction in Example 1. As a result, results substantially similar to the results in Table 1 were obtained, while reducing the amount of the treatment liquid applied.

According to the present invention, in the case of forming images successively at a high speed or on both sides of a recording medium, an image forming method can be provided, with which the occurrence of stacker blocking is prevented.

All publications, patent applications, and technical standards mentioned in this specification are herein incorporated by reference to the same extent as if each individual publication, patent application, or technical standard was specifically and individually indicated to be incorporated by reference.

Exemplary embodiments of the invention include, but are not limited to, the following.

<1> An image forming method comprising:

applying a treatment liquid onto a recording medium that has a coated layer and has an area of 1,250 $cm^2$ or more, applying an ink composition including a pigment and resin particles having a glass transition temperature (Tg) of 100° C. or higher onto the recording medium onto which the treatment liquid has been applied and which is conveyed at a conveyance speed of 200 mm/s or higher, heating and drying the applied treatment liquid and ink composition, cooling the recording medium that has been subjected to the heating and drying, to a temperature of 35° C. or lower, and accumulating the recording medium that has been subjected to the cooling, into an accumulation unit.

<2> The image forming method of <1>, wherein the glass transition temperature (Tg) of the resin particles is 150° C. or higher.

<3> The image forming method of <1> or <2>, wherein in accumulating the recording medium, blowing is carried out in the accumulation unit, where the recording media are accumulated, at least from a direction which intersects the accumulation direction of the recording media, to supply gas between the recording media accumulated in the accumulation unit.

<4> The image forming method of <3>, wherein in accumulating the recording medium, blowing is carried out with respect to a bundle of the recording media accumulated in the accumulation unit from at least one face of the bundle, to supply gas between the recording media that form the bundle at a time.

<5> The image forming method of <3> or <4>, wherein, in accumulating the recording medium, the quantity of gas that passes through, per one sheet of the recording medium and per unit length in the width direction of the recording medium when seen from a side from which the supplied gas is supplied, is 0.02 $m^3 \cdot min^{-1} \cdot m^{-1}$ or more.

<6> The image forming method of any one of <3> to <5>, wherein in accumulating the recording medium, air at the temperature and humidity of the environment of the surroundings of the accumulation unit is supplied as the gas to be supplied between the recording media accumulated in the accumulation unit.

<7> The image forming method of any one of <4> to <6>, wherein in accumulating the recording medium, blowing is carried out with respect to plural faces of the bundle of the recording media accumulated in the accumulation unit, from plural directions that respectively face the plural faces of the bundle of recording media accumulated in the accumulation unit.

<8> The image forming method of any one of <1> to <7>, wherein the ink composition further includes a water-soluble organic solvent and water.

<9> The image forming method of any one of <1> to <8>, wherein in applying of the treatment liquid, the treatment liquid is applied by an ink jet method.

<10> The image forming method of any one of <1> to <9>, wherein the treatment liquid includes a compound containing a carboxyl group, and has a pH of 6 or less.

<11> The image forming method of any one of <1> to <10>, wherein the treatment liquid and the ink composition are applied on both sides of the recording medium.

What is claimed is:

1. An image forming method comprising:

applying a treatment liquid onto a recording medium that has a coated layer and has an area of 1,250 $cm^2$ or more, applying an ink composition including a pigment and resin particles having a glass transition temperature (Tg) of 100° C. or higher onto the recording medium onto which the treatment liquid has been applied and which is conveyed at a conveyance speed of 200 mm/s or higher, heating and drying the applied treatment liquid and ink composition, cooling the recording medium that has been subjected to the heating and drying, to a temperature of 35° C. or lower, and accumulating the recording medium that has been subjected to the cooling, into an accumulation unit, wherein in accumulating the recording medium, blowing is carried out in the accumulation unit, where the recording media are accumulated, at least from a direction which intersects the accumulation direction of the recording media, to supply gas between the recording media accumulated in the accumulation unit, and in accumulating the recording medium, the quantity of gas that passes through, per one sheet of the recording medium and per unit length in the width direction of the recording medium when seen from a side from which the supplied gas is supplied, is 0.02 $m^3 \cdot min^{-1} \cdot m^{-1}$ or more.

2. The image forming method of claim 1, wherein the glass transition temperature (Tg) of the resin particles is 150° C. or higher.

3. The image forming method of claim 1, wherein in accumulating the recording medium, blowing is carried out with respect to a bundle of the recording media accumulated in the accumulation unit from at least one face of the bundle, to supply gas between the recording media that form the bundle at a time.

4. The image forming method of claim 1, wherein in accumulating the recording medium, air at the temperature and humidity of the environment of the surroundings of the accumulation unit is supplied as the gas to be supplied between the recording media accumulated in the accumulation unit.

5. The image forming method of claim 3, wherein in accumulating the recording medium, blowing is carried out with respect to plural faces of the bundle of the recording media accumulated in the accumulation unit, from plural directions that respectively face the plural faces of the bundle of recording media accumulated in the accumulation unit.

6. The image forming method of claim 1, wherein the ink composition further includes a water-soluble organic solvent and water.

7. The image forming method of claim 1, wherein in applying of the treatment liquid, the treatment liquid is applied by an ink jet method.

8. The image forming method of claim 1, wherein the treatment liquid includes a compound containing a carboxyl group, and has a pH of 6 or less.

9. The image forming method of claim 1, wherein the treatment liquid and the ink composition are applied on both sides of the recording medium.

* * * * *